US008139813B2

(12) United States Patent
Kobayashi et al.

(10) Patent No.: US 8,139,813 B2
(45) Date of Patent: Mar. 20, 2012

(54) SPEAKER DEVICE

(75) Inventors: Hiroyuki Kobayashi, Tendo (JP); Toshihiro Hikichi, Tendo (JP); Minoru Horigome, Tendo (JP); Yasuhisa Abe, Tendo (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 331 days.

(21) Appl. No.: 12/440,565

(22) PCT Filed: Jan. 28, 2008

(86) PCT No.: PCT/JP2008/051197

§ 371 (c)(1),
(2), (4) Date: Mar. 9, 2009

(87) PCT Pub. No.: WO2009/095984

PCT Pub. Date: Aug. 6, 2009

(65) Prior Publication Data

US 2011/0069859 A1 Mar. 24, 2011

(51) Int. Cl.
*H04R 1/00* (2006.01)

(52) U.S. Cl. ..... 381/398; 381/406; 381/431

(58) Field of Classification Search ..... None
See application file for complete search history.

(56) References Cited

U.S. PATENT DOCUMENTS

| | | | | |
|---|---|---|---|---|
| 4,146,756 | A * | 3/1979 | Kito et al. | 381/426 |
| 2009/0161905 | A1* | 6/2009 | Konuma et al. | 381/412 |
| 2009/0262972 | A1* | 10/2009 | Yuasa | 381/412 |

FOREIGN PATENT DOCUMENTS

| | | | |
|---|---|---|---|
| JP | 62-73898 | | 4/1987 |
| JP | 63-250995 | A | 10/1988 |
| JP | 6454899 | A | 3/1989 |
| JP | 8-149596 | | 6/1996 |
| JP | 2005-159409 | | 6/2005 |
| WO | 2005055646 | A1 | 6/2005 |

OTHER PUBLICATIONS

Patent Abstracts of Japan for patent application with Publication No. 62-073898, Date of Publication: Apr. 4, 1987, 1 page.

Patent Abstracts of Japan for patent application with Publication No. 08-149596, Publication Date: Jun. 7, 1996, 1 page.

(Continued)

*Primary Examiner* — Charles Garber
*Assistant Examiner* — Andre' C Stevenson
(74) *Attorney, Agent, or Firm* — Osha Liang LLP

(57) ABSTRACT

A flat speaker device capable of emitting loud reproduced sound with a relatively simple configuration is provided. The speaker device includes a diaphragm, a frame supporting the diaphragm vibratably in the vibration direction, a magnetic circuit disposed in the frame, and a driving member for driving the diaphragm. The driving member includes a voice coil movably disposed in a magnetic gap of the magnetic circuit, a driving part formed movably in a direction different from the vibration direction of the diaphragm, and an angle conversion and transmission part, one end of which is angle-variably joined to the driving part and another end of which is angle-variably joined to the diaphragm. The angle conversion and transmission part has rigidity and is obliquely disposed with respect to each of the vibration direction of the diaphragm and the moving direction of the driving part.

21 Claims, 17 Drawing Sheets

OTHER PUBLICATIONS

Patent Abstracts of Japan for patent application No. 2005-159409, Publication Date: Jun. 16, 2005, 1 page.
Extended European Search Report for Application No. 08704006.9 dated Aug. 6, 2010 (4 pages).
European Patent Abstracts for Japanese Publication No. 63250995 Published Oct. 18, 1988 (1 page).
European Patent Abstracts for Japanese Publication No. 6454899 Published Mar. 2, 1989 (1 page).

* cited by examiner

PRIOR ART

1H (A)

(B)

(A)

(B)

(C)

SPEAKER DEVICE

FIELD OF THE INVENTION

The present invention relates to a speaker device.

BACKGROUND ART

As a typical speaker device, there is known a dynamic speaker device as disclosed in JP-A No. 1996-149596 (FIG. 1) for example. As shown in FIG. 1, the dynamic speaker device described in this patent document includes a frame 3J; a cone-shaped diaphragm 21J; an edge 4J through which the diaphragm 21J is supported by the frame 3J; a voice coil bobbin 610J joined to the inner periphery of the diaphragm 21J; a damper 7J through which the voice coil bobbin 610 is supported by the frame 3J;
a voice coil 611J wound around the voice coil bobbin 610J; a yoke 51J; a magnet 52J; a plate 53J; and a magnetic circuit having a magnetic gap in which the voice coil 611J is placed.

In this speaker device, when an audio signal is input to the voice coil 611J, the voice coil bobbin 610J vibrates by a Lorentz force developed in the voice coil 611J and the vibration is transmitted to the diaphragm 21J to vibrate the same.

The typical dynamic speaker device described above is configured such that, as shown in FIG. 1, the voice coil 611J is disposed opposite to the sound emission side of the diaphragm 21J, and the vibration direction of voice coil 611J and voice coil bobbin 610J is parallel to the vibration direction of the diaphragm 21J. Since the speaker device of this configuration requires, for example, a region for vibration of the diaphragm 21J, a region for vibration of the voice coil bobbin 610J, and a region for disposing the magnetic circuit, the length (total height of the speaker device) in the vibration direction (sound emission direction) of the diaphragm 21J is relatively large.

Specifically, as shown in FIG. 1 for example, the dimension in the vibration direction of the diaphragm 21J of the above mentioned speaker device is determined by: the total of the length of the cone-shaped diaphragm 21J in the vibration direction and the height (a) of the edge 4J through which the diaphragm 21J is supported by the frame 3J; the distance (b) in the vibration direction from the junction of the diaphragm 21*j* and damper 7J to the plate 53J of the magnetic circuit; the winding width (c) of the voice coil 611J; the distance (d) in the vibration direction from the bottom of the voice coil 611J to the yoke 51J of the magnetic circuit; the thickness (e) of the yoke of the magnetic circuit; the maximum amplitude of the voice coil bobbin 610J while the speaker is driven; the thickness of the frame 3J supporting the diaphragm 21J and the magnetic circuit, and the like.

Particularly, in a loud speaker device, it is necessary to increase the distance (b) in the vibration direction from the junction of diaphragm 21J to damper 7J, the winding width (c) of the voice coil 611J, the distance (d) in the vibration direction from the bottom of the voice coil 611J to the yoke 51J of the magnetic circuit, and the like, and the dimension (sound emission direction) in the vibration direction of the diaphragm 21J is relatively large.

That is, since the above mentioned speaker device is configured such that the vibration direction of the voice coil bobbin 610J and the vibration direction of the diaphragm 21J become substantially parallel, it is relatively difficult to manage a thinner and larger sound-volume loudspeaker.

Also, in the typical dynamic speaker device, since the voice coil bobbin 610J is joined to an inner periphery of the cone-shaped diaphragm 21J and a driving force is transmitted from the voice coil bobbin 610J to the inner periphery of the diaphragm 21J, it is relatively difficult to drive the entire diaphragm substantially in-phase. Therefore, a speaker device allowing the entire diaphragm to be vibrated substantially in-phase is desirable.

As a flat speaker device, there is known an electrostatic speaker device. The electrostatic speaker device has such a structure that a diaphragm (movable electrode) and a fixed electrode are arranged opposite to each other. In this speaker device, the diaphragm is displaced by application of a DC voltage across the electrodes, and when a signal superimposed with an audio signal is input to the electrodes, the diaphragm vibrates in response to the signal.

In the above mentioned electrostatic speaker device, however, if an audio signal of relatively large amplitude is input, a driving force may nonlinearly vary considerably and thereby quality of a reproduced sound may be relatively deteriorated.

SUMMARY OF THE INVENTION

It is an object of the present invention to overcome the problem described above. That is, an object of the present invention is to provide a flat speaker device capable of emitting a loud reproduced sound with a relatively simple structure, a flat speaker device capable of emitting a high-quality reproduced sound with a relatively simple structure, a flat speaker device whose diaphragm vibrates substantially in-phase with a simple configuration, and the like.

To achieve the above mentioned object, the present invention has at least a configuration relative to the following independent claims:

A speaker device of the present invention includes a diaphragm; a frame vibratably supporting a diaphragm in the vibration direction; a magnetic circuit disposed in the frame; and a driving member to drive the diaphragm, the driving member including a voice coil movably disposed in a magnetic gap of the magnetic circuit; a driving part formed movably in a direction different from the vibration direction of the diaphragm; and a rigid angle conversion and transmission part, one end of which is angle-variably joined to the driving part and another end of which is angle-variably joined to the diaphragm, and which is obliquely disposed with respect to each of the vibration direction of the diaphragm and the moving direction of the driving part.

BRIEF DESCRIPTION OF THE DRAWINGS

FIG. 2A is a front view of the speaker device 1 according to the first embodiment of the present invention and FIG. 2B is a cross-sectional view of the speaker device shown in FIG. 2A taken along the A-A line.

FIG. 6A is a cross-sectional view of the speaker device 1 wherein a diaphragm 21 is positioned at a reference position, FIG. 6B is a cross-sectional view of the speaker device 1 wherein the diaphragm 21 is displaced towards the sound emission side with respect to the reference position, FIG. 6C is a cross-sectional view of the speaker device 1 wherein the diaphragm 21 is displaced towards the opposite of the sound emission side with respect to the reference position, and FIG. 6D is a diagram illustrating the operation of the diaphragm 21 and the driving member 26 of the speaker device 1;

FIG. 7A is a cross-sectional view of the speaker device wherein the diaphragm is not displaced with respect to the reference position, FIG. 7B is a cross-sectional view of the speaker device 1A wherein the diaphragm is displaced towards the sound emission side with respect to the reference position, and FIG. 7C is a cross-sectional view of the speaker 1A wherein the diaphragm is displaced towards the opposite of the sound emission side with respect to the reference position;

FIG. 8A is a cross-sectional view of the speaker device 1B wherein the diaphragm is not displaced with respect to the reference position, FIG. 8B is a cross-sectional view of the speaker device 1B wherein the diaphragm is displaced towards the sound emission side with respect to the reference position, and FIG. 8C is a cross-sectional view of the speaker device 1B wherein the diaphragm is displaced towards the opposite of the sound emission side with respect to the reference position;

PREFERRED EMBODIMENT OF THE INVENTION

Figure 1:
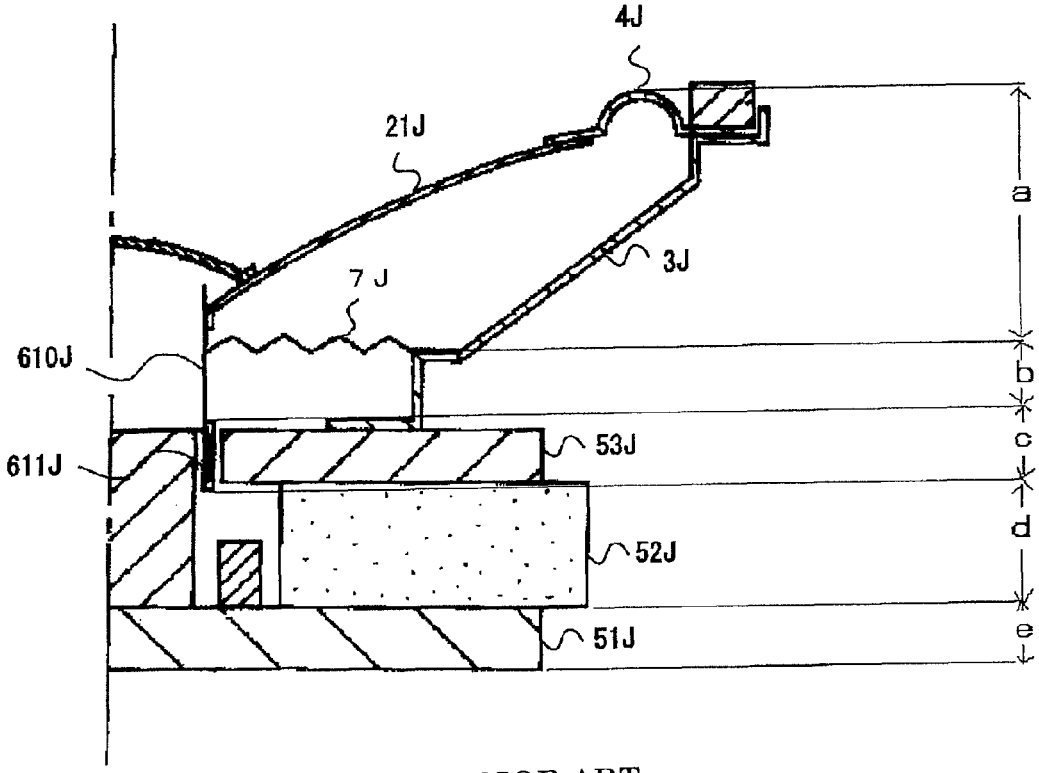
FIG. 1 is a diagram illustrating a speaker device of a prior art.

A speaker device according to one embodiment of the present invention includes a diaphragm; a frame vibratably supporting the diaphragm in a vibration direction; a magnetic circuit disposed in the frame; and a driving member to drive the diaphragm, the driving member including a voice coil movably disposed in a magnetic gap of the magnetic circuit, a driving part formed movably in a direction different from the vibration direction of the diaphragm, and a rigid angle conversion and transmission parts, one end of which is angular-variably joined to the driving part, the other end of which is angular-variably joined to the diaphragm, and which is obliquely disposed with respect to each of the vibration direction of the diaphragm and the moving direction of the driving part.

Preferably, one end of the angle conversion and transmission part is bendably or foldably joined to the driving part and the other end is bendably or foldably joined to the diaphragm.

Preferably, one end of the angle conversion and transmission part where the folding part is formed vibrates in the moving direction of the driving part and the other end vibrates in the vibration direction of the diaphragm, and a driving force generated by the driving part in the moving direction is redirected to the vibration direction of the diaphragm to transmit the driving force from the driving part to the diaphragm.

Preferably, the driving part is formed movably in a direction perpendicular to the vibration direction of the diaphragm.

In the speaker device of the above configuration, for example, when an audio signal is input to the voice coil, a Lorentz force is developed in the voice coil disposed in a magnetic gap of the magnetic circuit, causing the driving part to vibrate in a direction different from the vibration direction of the diaphragm, preferably in a direction perpendicular to the vibration direction of the diaphragm. The angle conversion and transmission part causes the one end thereof to vibrate in the moving direction of the driving part and the other end to vibrate in the vibration direction of the diaphragm, and thereby converts the angle of the driving force to transmit the driving force from the driving part to the diaphragm. The diaphragm vibrates in the vibration direction thereof due to the driving force that is transmitted from the angle conversion and transmission part.

In a typical speaker device, since a voice coil bobbin is disposed on the back of a diaphragm such that the vibration direction of the diaphragm and that of the voice coil bobbin are configured substantially parallel to each other, for example, it is necessary to have a region in which the diaphragm and the voice coil bobbin vibrate in the vibration direction, thus making the dimension of the speaker device relatively large in the sound emission direction.

On the other hand, the speaker device of the present invention includes the driving part movably disposed in a direction different from the vibration direction of the diaphragm, preferably in a direction perpendicular to the vibration direction of the diaphragm, and the angle conversion and transmission part obliquely disposed with respect to each of the vibration direction of the diaphragm and the moving direction of the driving part, and therefore the sound emission direction dimension is smaller than the typical speaker device described above. This means that it is possible to provide a flat speaker device.

Also, compared with a typical electrostatic speaker device, the speaker device of the present invention converts, via the angle conversion and transmission part of the above configuration, the angle of a driving force developed in the voice coil of the driving part and transmits it to the diaphragm, and therefore it is possible to emit a relatively loud and relatively high quality sound.

Further, a speaker device adapted to, for example, transmit a driving force from a voice coil to a diaphragm by utilizing the flexibility of a flexible member has a problem that the flexible member tends to resonate (especially at low frequencies). Compared with such a speaker device, since the speaker device of the present invention transmits a driving force from the driving part to the diaphragm by means of a rigid angle conversion member, it is possible to vibrate the diaphragm with relatively high sensitivity without a decrease in response due to a deflection of a flexible member for example.

The speaker device of the present invention can be used for various appliances such as mobile phones, in-vehicle speakers, speakers for personal computers, and speakers for television broadcasting receivers.

The speaker device according to preferred embodiments of the present invention will be described hereinafter in conjunction with accompanied drawings.

First Embodiment

Figure 2:
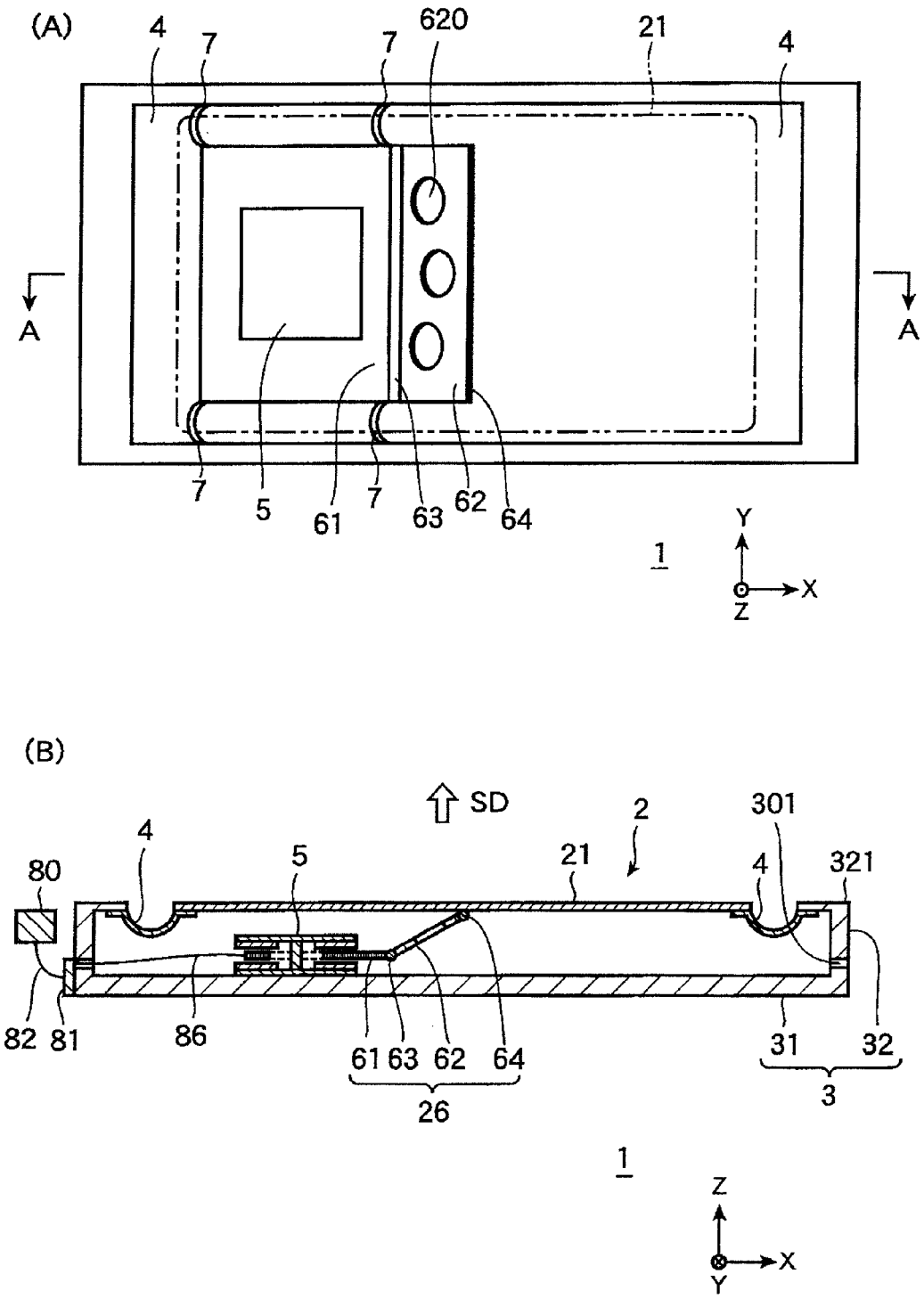
FIGS. 2A and 2B are diagrams illustrating a speaker device 1 according to a first embodiment of the present invention. Specifically.

FIGS. 2A and 2B are diagrams illustrating the speaker device 1 according to a first embodiment of the present invention. Specifically, FIG. 2A is a front view of the speaker device 1 according to the first embodiment of the invention (the diaphragm is not shown) and FIG. 2B is a cross-sectional view of the speaker device 1 shown in FIG. 2A taken along the A-A line.

Figure 3:
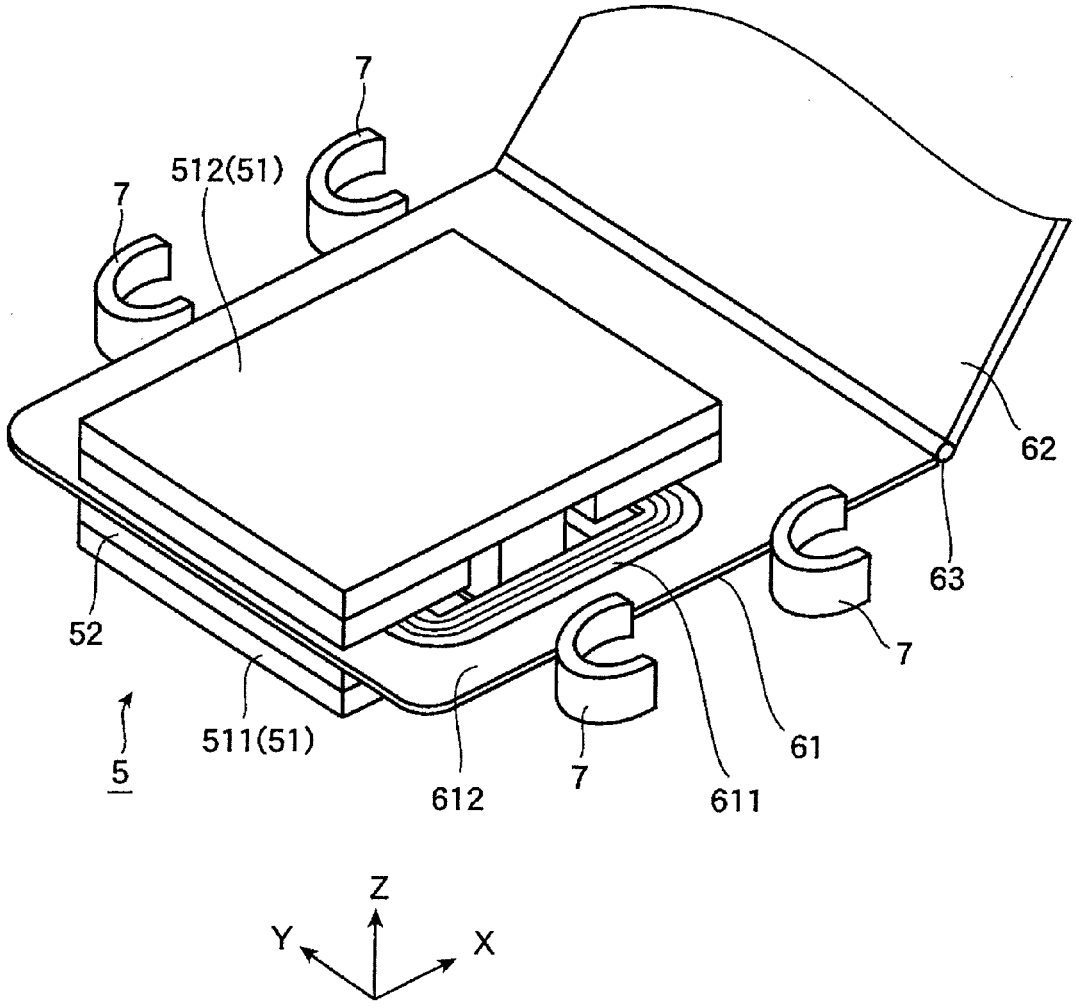
FIG. 3 is an enlarged perspective view of an area in the vicinity of a magnetic circuit 5 of the speaker device 1 shown in FIGS. 2A and 2B.
Figure 4:
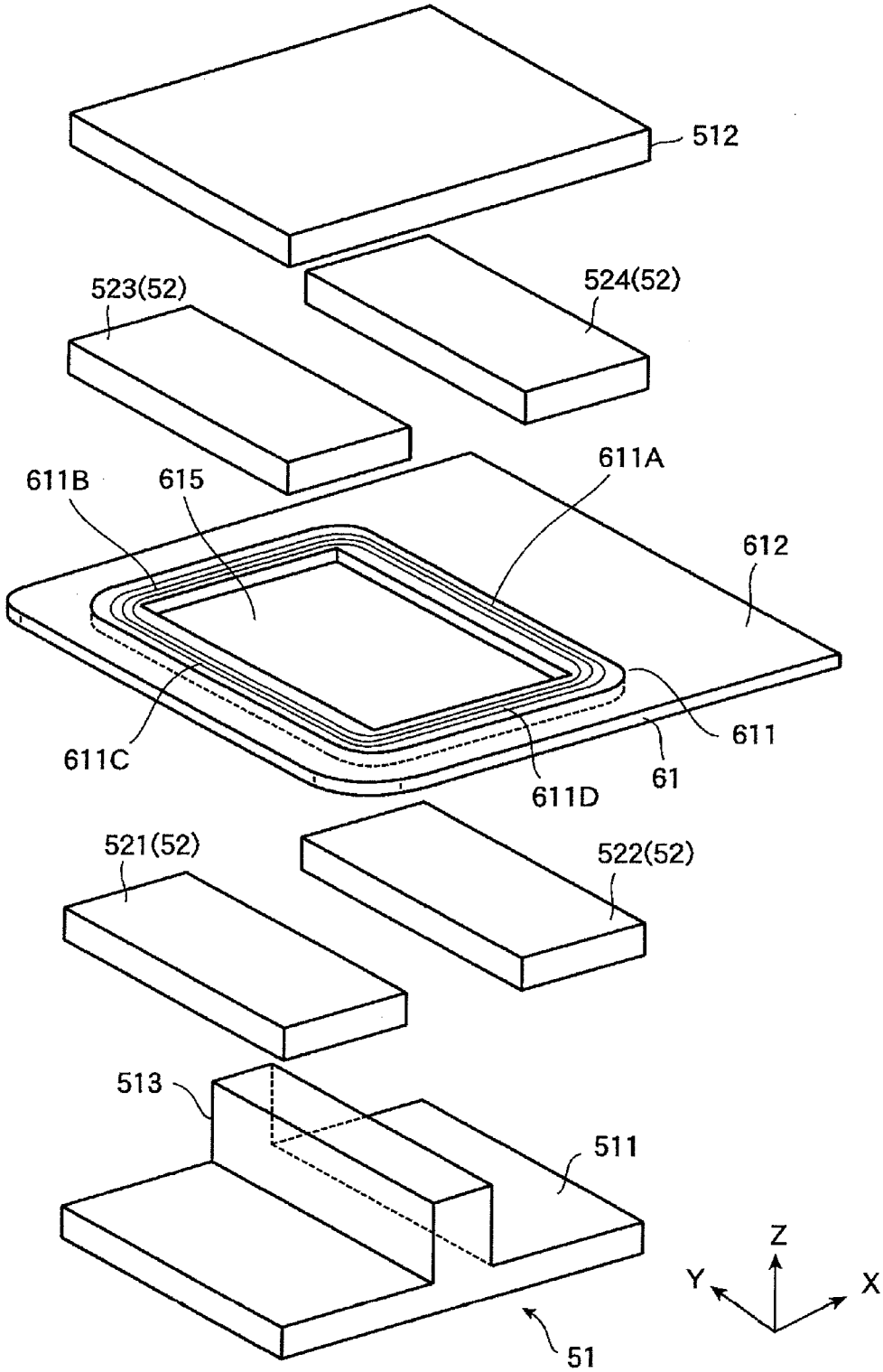
FIG. 4 is an exploded perspective view of the magnetic circuit 5 of the speaker device 1 shown in FIG. 3.
Figure 5:
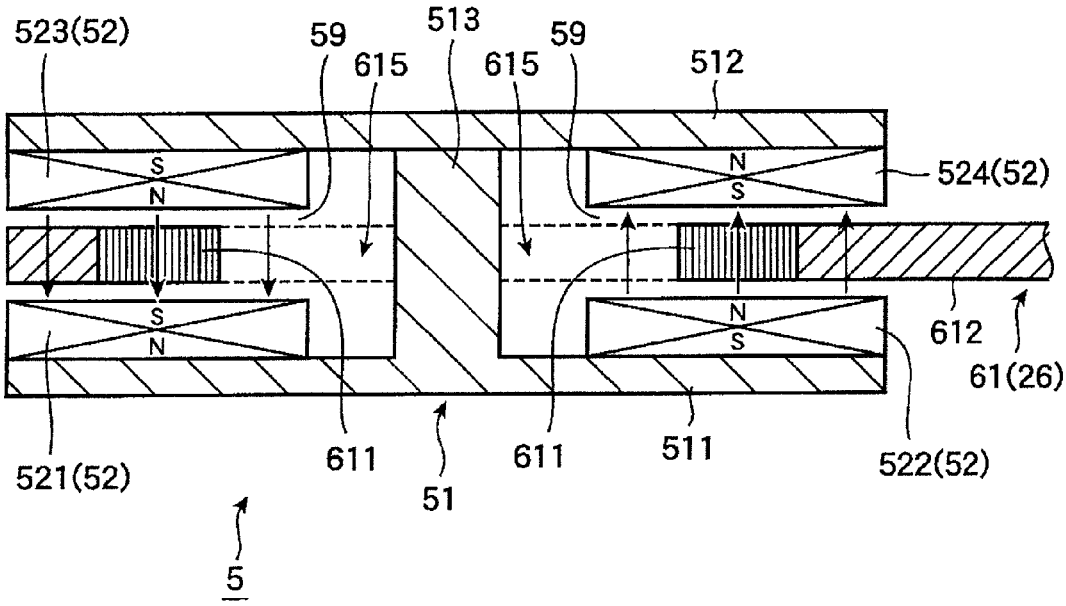
FIG. 5 is a cross-sectional view of the magnetic circuit 5 of the speaker device 1 shown in FIGS. 2A to 2B.

FIG. 3 is an enlarged perspective view of the vicinity of the magnetic circuit 5 of the speaker device 1 shown in FIGS. 2A and 2B. FIG. 4 is an exploded perspective view of the magnetic circuit 5 of the speaker device 1 shown in FIG. 3. FIG. 5 is a cross-sectional view of the speaker device 1 shown in FIGS. 2A and 2B. The sound emission direction (SD) of the diaphragm 21 of the speaker device 1 is defined as Z-axis direction, the lengthwise direction (driving direction of the driving part) as X-axis direction, and the direction perpendicular to the Z-axis and the X-axis as Y-axis direction.

As shown in FIGS. 2A to 5, the speaker device according to the first embodiment of the present invention includes a vibrating body 2; a frame 3; an edge (support member) 4; a magnetic circuit 5; and a damper 7 (restraint part). The vibrating body 2 includes a diaphragm 21 and a driving member 26. The driving member 26 include a driving part 61 having a voice coil 611, and an angle conversion and transmission part 62.

The diaphragm 21 corresponds to one aspect of the diaphragm of the present invention, and the driving member 26 corresponds to one aspect of the driving member of the present invention. The frame 3 corresponds to one aspect of the frame of the present invention, and the magnetic circuit 5 corresponds to one aspect of the magnetic circuit of the present invention. The voice coil 611 corresponds to one aspect of the voice coil of the present invention. The driving part 61 corresponds to one aspect of the driving part of the present invention. The angle conversion and transmission part 62 corresponds to one aspect of the angle conversion and transmission part of the present invention. The folding part 63 corresponds to one aspect of the folding part of the present invention. The damper (restraint part) 7 corresponds to one aspect of the restraint part of the present invention.

The speaker device 1 includes the driving part 61 which includes the voice coil 611 and which is formed so as to be movable in a direction different from the vibration direction of the diaphragm 21, specifically a direction perpendicular to the vibration direction of the diaphragm 21; and the rigid angle conversion and transmission part 62, one end of which is foldable joined to the driving part, the other end of which is foldably joined to the diaphragm 21, and which is obliquely disposed with respect to each of the vibration direction of the diaphragm 21 and the moving direction of the driving part 61.

Specifically, for example, the speaker device 1 includes a driving member (cantilever) 26 that can be folded at a movable joint (folding part), the driving member 26 being foldably joined to the diaphragm 21 at an end portion thereof, causing the diaphragm 21 to vibrate in the sound emission direction (SD) by converting the angle of a driving force in a direction determined by the voice coil 611 to a direction different from the determined direction and transmitting it to the diaphragm 21. Each component of the speaker device 1 of this embodiment is described below.

[Vibrating Body 2]

The vibrating body 2 is vibratably supported by the frame 3 and includes the diaphragm 21 and the driving member 26 in this embodiment.

[Diaphragm 21]

The diaphragm 21 is vibratably supported by the frame 4 in the vibration direction (Z direction), as shown in FIGS. 2A, 2B, and 3. The diaphragm 21 emits a sound wave in the sound emission direction (SD) when the speaker is driven. The diaphragm 21 of this embodiment is supported by the frame 3 via the edge 4, and a movement in other than the vibration direction, specifically in the X or Y direction, is restrained by the edge 4. The edge 4 and the diaphragm 21 may be integrally formed.

The diaphragm 21 may be made of, for example, resin, metal, ceramic, or composite material. The diaphragm 21 preferably has rigidity for example. The diaphragm 21 is formed into a specified shape such as a flat plate, a dome shape, or a cone shape. The diaphragm 21 of this embodiment is formed into a flat plate shape. Also, the diaphragm 21 is formed into a specified shape (planar shape) as seen from the sound emission direction (SD), such as a rectangular, elliptical, circular, or polygonal shape. The top of the diaphragm 21 of this embodiment has a planar shape.

Since the diaphragm 21 is vibratably supported by the frame 4 and a space sandwiched between the diaphragm 21 and the frame 4 at the back (opposite to the sound emission direction) of the diaphragm 21 is closed, it is possible to suppress the emission of sound waves from the back of the diaphragm 21.

[Frame 3]

The frame 3 vibratably supports the diaphragm 21 in the vibration direction. The top of the frame 3 of this embodiment is rectangular in shape and the cross-section thereof is in a concave shape as seen from the sound emission direction (SD). Also, the frame 3 supports the diaphragm 21 at the upper end and accommodates the magnetic circuit 5.

As shown in FIGS. 2A and 2B, the frame 3 includes a flat plate 31 whose top is rectangular, and a rectangular tubular part 32 extending from a periphery of the flat plate part 31 towards the sound emission direction (SD), and has an opening formed in the top. Further, the magnetic circuit 5 is disposed on the flat plate part 31, a periphery of the edge 4 is joined to an upper end of the tubular part 32 with an adhesive or the like, and the diaphragm 21 supported by the edge 4 is disposed in the opening. In this embodiment, an inwardly-extending upper planer part 321 is formed at the upper end of the tubular part 32, and the edge 4 is joined to the upper planar part 321. The frame 3 may be made of a known material such as resin and metal. Also, as shown in FIG. 2B, the frame 3 has holes 301 formed on its side and bottom surfaces. These holes 301 function as vent holes for example.

For example, if vent holes are not provided, there is a possibility that air in the space surrounded by the diaphragm 21 and the frame 3 behaves like a spring as the diaphragm 21 vibrates when the speaker is driven, and thereby vibration of the diaphragm 21 is dampened. In contrast, the speaker device 1 of this embodiment has the holes 301 and therefore such a damping of vibration of the diaphragm 21 can be suppressed. Also, these holes serve as vent holes for heats generated by the magnetic circuit 5 and the voice coil 611.

Further, the holes 301 may be used as holes through which conductive wires electrically connecting an audio processing device 80 of an amplifier, an equalizer, tuner, broadcasting receiver, a television, and the like to the voice coil 611. Also, a terminal 81 may be provided on the frame 3. At this time, the audio processing device 80 and the terminal 81 are electrically connected by the conductive wire 82, and the terminal 81 and the voice coil 611 are electrically connected by the conductive wire 86.

The audio processing device 80 is not limited to the above-mentioned embodiment, and the audio processing device may be disposed within the speaker device 1 for example.

[Edge 4]

The edge 4 is disposed between the diaphragm 21 and the frame 3, and the inner periphery thereof supports the outer periphery of the diaphragm 21 and also holds the diaphragm 21 in a determined/specified position by joining the outer periphery to the frame. Specifically, the edge 4 supports the diaphragm 21 vibratably in the vibration direction (Z direction) and suppresses vibrations in a direction perpendicular to the vibration direction. The edge 4 of this embodiment is formed in a ring shape as seen from the sound emission direction. As shown in FIG. 2B, the edge 4 has a specified cross-sectional shape, such as convex, concave, or corrugated shape. In this embodiment, the edge 4 is concave toward the sound emission direction. The edge 4 may be made of, for example, leather, fabric, rubber, resin, or leather, fabric, rubber, or resin each of which is sealed with sealer or coated rubber or resin formed into a specified shape, or the like.

[Magnetic Circuit 5]

The magnetic circuit 5 is disposed in the frame 3. The magnetic circuit 5 of this embodiment is accommodated in the frame 3 as shown in FIGS. 2A and 2B, specifically, disposed on the flat plate part 31 of the frame 3. Also, the magnetic circuit 5 of this embodiment is disposed opposite of the sound emission direction with respect to the diaphragm 21 as shown in FIG. 2B. As the magnetic circuit 5, an inner magnet type magnetic circuit, an outer magnet type magnetic circuit, or the like may be employed for example.

The magnetic circuit 5 of this embodiment includes a yoke 51 and a magnet 52 as shown in FIGS. 2A to 5. The magnetic circuit 5 of this embodiment has a plurality of magnets 521 to 524. In the magnetic circuit 5, the magnet 52 is provided on both sides of a magnetic gap in the magnetic field direction as shown in FIGS. 2A to 5. For example, the magnetic gap 59 is formed into a groove shape so that the voice coil 611 can move within a specified range in a specified direction.

The yoke 51 includes a lower flat part 511, an upper flat part 512, and a support 513. The lower flat part 511 and the upper flat part 512 are arranged substantially parallel to each other with a specified space between them, and the support 513 is formed in the center such that it extends in a substantially orthogonal direction with respect to the lower flat part 511 and the upper flat part 512.

When an audio signal (current) flows through a conductive wire (voice coil) in a magnetic field, a Lorentz force is developed in a direction perpendicular to each of the magnetic field direction and the electric current direction according to Fleming' s left-hand rule. In the speaker device 1 of this embodiment, the voice coil 611 and the magnetic circuit 5 are configured such that a Lorentz force is developed in the voice coil 611 in a specified direction different from the vibration direction of the diaphragm 21, specifically, in a direction (for example X direction) perpendicular to the vibration direction (Z direction) to vibrate the voice coil 611 vibrates in the X direction. The magnets 521 to 524 are arranged on the flat parts 511 and 512.

The voice coil 611 of this embodiment has a substantially rectangular top as seen from the sound emission direction (SD), and is configured of straight parts 611A and 611C formed in the Y direction and straight parts 611B and 611D formed in the X direction. The straight parts 611A and 611C are disposed in the magnetic gap 59 of the magnetic circuit 5 and are specified to have a magnetic field in the Z direction. It is preferable not to apply a magnetic field to the straight parts 611B and 611D of the voice coil 611. Also, even when a magnetic field is applied to the straight parts 611B and 611D, Lorentz forces developed in the straight parts 611B and 611D cancel each other.

Further, since the voice coil 611 of this embodiment is formed in a shape of a flat plate, it is possible to make a portion in the magnetic gap relatively large by increasing the winding number and thereby obtain a relatively strong driving force when the speaker is driven.

The magnetic circuit 5 of this embodiment is formed such that a magnetic field is generated in the Z direction as shown in FIG. 5. Specifically, as shown in FIG. 5, a plurality of magnets 521 to 524 are arranged such that the direction of a magnetic field in the straight part 611A of the voice coil 611 is opposite to the direction of a magnetic field in the straight part 611C. Also, this embodiment is configured such that an audio signal flowing in the straight part 611A and an audio signal flowing in the straight part 611C of the voice coil 611 are opposite to each other in direction.

In the speaker device 1 having the above configuration, when an audio signal is input to the voice coil 611, the straight part 611A and straight part 611C develop a Lorentz force in the same direction, and therefore a driving force is twice as strong as in such a configuration that, for example, a magnetic field is applied to only one of the straight parts 611A and 611C.

Accordingly, the magnetic circuit 5 of the above configuration and the voice coil 611 configured as described above can be made flat and also can develop a relatively strong driving force.

[Driving Member 26]

The driving member 26 includes the above mentioned voice coil 611 to drive the diaphragm 21. When an audio signal is input, the driving member 26 transmits a driving force (Lorentz force) developed in the voice coil 611 to the diaphragm 21 to vibrate the same.

Specifically, the driving member 26 includes a driving part with a voice coil 61, an angle conversion and transmission part (transmission part) 62, and folding parts 63 and 64.

[Driving Part 61]

The driving part 61 includes the voice coil 611 movably disposed in the magnetic gap 59 of the magnetic circuit 5, and is formed to be movable in a direction different from the vibration direction of the diaphragm 21.

Specifically, the driving part 61 of this embodiment is formed to be movable only in the X direction and restrictive in movements in other directions. This restriction on moving range of the driving part 61 is implemented by dampers 7 as restraint parts in this embodiment, but is not limited to this embodiment. For example, the damper 7 may be a groove having an edge shape.

Further, the driving part 61 includes the voice coil 611 disposed in the magnetic gap 59 of the magnetic circuit 5, and an insulation member 612 extending from the voice coil to outside of the magnetic gap in the moving direction of the voice coil. The angle conversion and transmission part 62 is joined to the end on the moving direction side of the insulation member via the folding part 63.

Also, the driving part 61 has an opening 615 and the voice coil 611 is joined to the inner periphery of the opening 615.

Since the driving part 61 of the above configuration has such a structure that the voice coil 611 is inserted into the insulating member 612, it is possible to reinforce the strength of the voice coil 611 and thereby reduce the deflection thereof.

The opening 615 of this embodiment is loosely fitted into the support part 513 of the magnetic circuit 5 and the moving range of the driving part 61 is restrained in this state. Specifically, the opening part 615 has a rectangular shape and the interval between the sides thereof in the moving direction of the driving part 61 is substantially equal to or longer than the width of the support part 513, and the interval between the sides in a direction perpendicular to the moving direction is relatively long in accordance with the moving range of the driving part 61.

Since the driving part 61 of the above configuration has such a configuration that the opening part 615 is loosely fitted into the support part 513 of the magnetic circuit 5, it is possible to make the installation space for the magnetic circuit 5 and the driving part 61 relatively small.

[Angle Conversion and Transmission Part 62]

The angle conversion and transmission part 62 is disposed between the driving part 61 and the diaphragm 21 and transmits a driving force from the driving part 61 to the diaphragm 21.

Specifically, one end of the angle conversion and transmission part 62 is angle-variably joined to the driving part 61 and the other end is angle-variably joined to the diaphragm 21.

More specifically, one end of the angle conversion and transmission part 62 is foldably or bendably joined to the driving part 61 and the other end is foldably or bendably joined to the diaphragm 21.

That is, the bottom of the angle conversion and transmission part 62 is foldably joined to an end of the driving part via, for example, the folding part 63, and is movable only in the horizontal direction (X-axis direction, i.e., moving direction of the driving part 61), movements in other direction, for example Z or Y-axis direction, being restrained.

Also, the upper end of the angle conversion and transmission part 62 is foldably joined to the diaphragm 21 via the folding part 64, and is movable only in the sound emission direction (Z direction), movements in other directions, for example Y or Z-axis direction, being restricted.

In this embodiment, the upper end of the angle conversion and transmission part 62 is foldably joined to the back of the barycentric position of the diaphragm 21.

Further, the angle conversion and transmission part 62 is obliquely disposed with respect to each of the vibration direction (Z-axis direction) of the diaphragm 21 and the moving direction (X-axis direction) of the driving part 61. Also, the angle conversion and transmission part 62 is made of, for example, a rigid material and thus has rigidity. In other words, it has little flexibility.

The angle conversion and transmission part 62 of this embodiment is in the shape of a plate, but is not limited thereto, and may be formed in the shape of a rod. For example, the angle conversion and transmission part may well be rigid in such a shape that the distance between the part joining the driving part 61 and the part joining the diaphragm 21 is constant, even when the speaker is driven. The angle conversion and transmission part 62 may be in a specified corrugated shape, for example. Thus, since the angle conversion and transmission part 62 has rigidity, it is possible to transmit a driving force from the driving part 61 to the diaphragm 21 without deflecting or stretching when the speaker is driven. Also, since the angle conversion and transmission part 62 has rigidity, vibration in an eigen-frequency mode hardly occurs, making it possible to suppress an effect on the vibration of the diaphragm 21 and prevent a deterioration of acoustic characteristics.

The angle conversion and transmission part 62 of this embodiment has a vent hole for example. This vent hole 620 prevents the damping of the angle conversion and transmission part 62 due to air, by reducing local variations in air pressure in the space surrounded by the diaphragm 21 and the frame 3 when the speaker is driven. It also prevents deterioration of sound quality. Specifically, it is possible to prevent the air pressure in a space surrounded by the diaphragm 21, angle conversion and transmission part 62, and driving part 61, and the air pressure in a space surrounded by the different driving part 61 and the angle conversion and transmission part joined to and facing that driving part from differing substantially.

[Folding Part 63]

The folding part 63 is formed, for example, between the driving part 61 and the angle conversion and transmission part 62, and foldably joins the driving part 61 and the angle conversion and transmission part 62. The folding part 63 may be configured of a mechanical joint, a member made of polymeric fiber such as polyester fiber and polyaramid fiber, a member made of polyurethane resin or rubber, or a flexible member made of flexible film or the like. It is also possible to form the folding part 63 by integrally forming, for example, the driving part 61 and the angle conversion and transmission part 62 of a specified material such as resin and then making it foldable at a specified portion.

[Folding Part 64]

The folding part 64 is formed between the angle conversion and transmission part 62 and the diaphragm 21 and foldably joins the angle conversion and transmission part 62 and the diaphragm 21. The folding part 64 may be configured of a mechanical joint or a member made of flexible material such as flexible film. Also, it is possible to foldably join the angle conversion and transmission part 62 and the diaphragm 21 by forming the folding part 64 in the vicinity of an end of the angle conversion and transmission part 62 and then forming the end of the angle conversion and transmission part 62 in such a structure that it fits into a groove or hole formed in the diaphragm 21.

In the embodiment described above, the driving member 26 and the diaphragm 21 are different members, but the present invention is not limited to this embodiment. It is also possible to form the driving member 26 and the diaphragm 21 integrally. Further, the driving part 61 and the angle conversion and transmission part 62 may be integrally formed and the angle conversion and transmission part 62 and the diaphragm 21 may be integrally formed.

It is also possible to form the bending part by integrally forming, for example, the diaphragm 21 and the angle conversion and transmission part 62 of a specified material such as resin and then making it foldable at a specified portion.

Further, it is possible to angle-variably join an end of the angle conversion and transmission part 62 and the driving part 61 and angle-variably join the other end thereof and the diaphragm 21, by making bendable the part joining the driving part 61 and the angle conversion and transmission part 62 and making foldable the part joining the diaphragm 21 and the angle conversion and transmission part 62. It is also possible to make foldable the part joining the driving part 61 and the angle conversion and transmission part 62, make bendable the part joining the diaphragm 21 and the angle conversion and transmission part 62, or make bendable both the part joining the driving part 61 and the angle conversion and transmission part 62 and the part joining the diaphragm 21 and the angle conversion and transmission part 62. Thus, the invention is not limited to any of these embodiments.

[Restraint Part 7]

The restraint part (damper 7) holds the driving part 61 in position within the magnetic gap 59 of the magnetic circuit 5 such that the driving part 61 will not contact the magnetic circuit 5, and also vibratably supports the driving part 61 in the driving direction (X-axis direction). The damper 7 restrains a movement of the driving part 61 in a direction different from the driving direction of the driving part 61, for example the Z or Y-axis direction. The damper 7 of this embodiment is, for example, formed in a shape of plate and thus has flexibility. Also, the damper 7 may have various cross-sectional shapes such as convex, concave, and corrugated shape, and the thickness thereof may be uniform or not.

The damper 7 joins with the driving part 61 at one end and joins with the frame 3 at the other end, for example. The damper 7 is not limited to this embodiment, and it may be configured to join with the driving part at one end and join with the magnetic circuit 5 at the other end for example.

It is also possible to provide a rail, a groove, a step, or the like in the frame 3 in order to restrain the moving range of the driving part 61. That is, the speaker device 1 may have such a structure that the driving part 61 slides with an end of the driving part 61 being fitted into a rail, a groove, a step, or the like.

[Operation]

Figure 6:
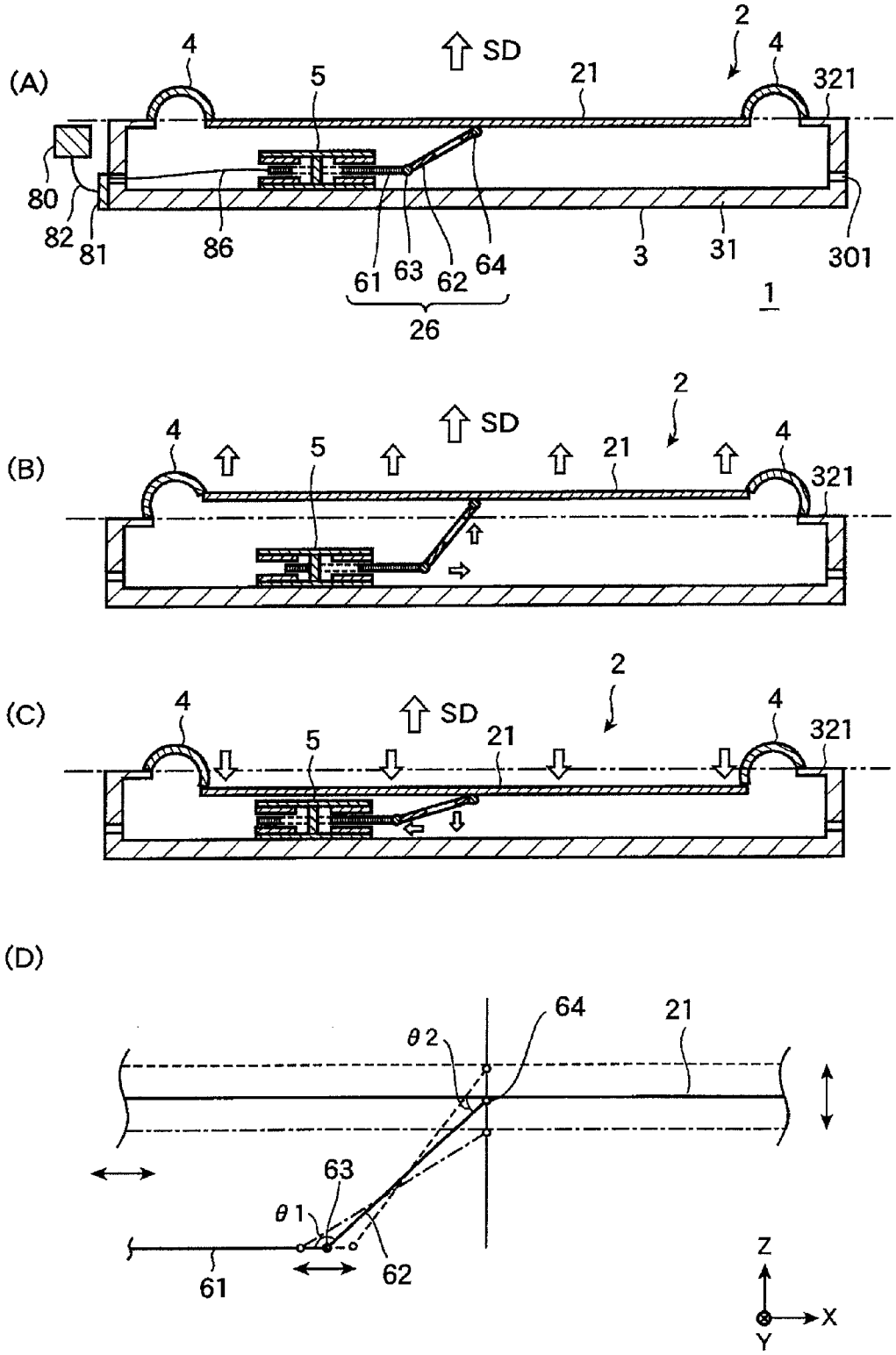
FIGS. 6A to 6D are diagrams illustrating the operation of the speaker device 1 according to the first embodiment of the present invention. Specifically.

FIGS. 6A to 6D are diagrams illustrating the operation of the speaker device 1 according to the first embodiment of the present invention. FIG. 6A is a cross-sectional view of the speaker device 1 whose diaphragm 21 is placed at a reference position. FIG. 6B is a cross-sectional view of the speaker device 1 whose diaphragm 21 is displaced to the sound emission side with respect to the reference position. FIG. 6C is a cross-sectional view of the speaker device 1 whose diaphragm 21 is displaced to the side opposite of the sound emission side with respect to the reference position. FIG. 6D is a diagram illustrating the operation of the diaphragm 21 and the driving member 26 of the speaker device 1.

[Before Driving]

For example, before the speaker is driven, the driving part 61, the angle conversion and transmission part 62, and the diaphragm 21 are placed at their reference positions. At rest, an angle θ1 formed by the driving part 61 and the angle conversion and transmission part 62 is a specified angle (about 150 degrees), and an angle θ2 formed by the diaphragm 21 and the angle conversion and transmission part 62 is a specified angle (about 30 degrees). The angle conversion and transmission part 62 is obliquely disposed with respect to each of the driving part 61 and the diaphragm 21 respectively.

The angles θ1 and θ2 are not limited to the above embodiment. Also, angles θ1 and θ2 are preferably other than 0 and 90 degrees.

[When Speaker is Driven]

When an audio signal is input to the voice coil 611 from the audio processing device 80 or the like through the conductive wire 82, the terminal 81, and the conductive wire 86, a Lorentz force is developed in the X-axis direction within the voice coil 611 disposed in the magnetic gap 59 of the magnetic circuit 5.

Specifically, when an audio signal is input to the voice coil 611, the driving part 61 vibrates in the X-axis direction in response to a Lorentz force developed in the voice coil 611 as shown in FIGS. 6B and 6C.

Also, the bottom of the angle conversion and transmission part 62 vibrates in the moving direction (X direction) of the driving part 61, and the top thereof vibrates in the vibration direction (Z direction), and the moving direction of a driving force generated by the voice coil is converted to the vibration direction of the diaphragm 21 to transmit the driving force from the driving part 61 to the diaphragm 21.

Then, the diaphragm 21 vibrates in the Z direction in response to a driving force transmitted from the angle conversion and transmission part 62.

In the speaker device 1 of the above configuration, the amount of movement in X direction of the driving part 61 varies with the amount of movement in Z direction of the diaphragm 21. Since this relationship is determined by the length and the like of each of the driving part 61, the diaphragm 21, and the angle conversion and transmission part 62, these values are set so as to attain desired acoustic characteristics. In the speaker device 1 of this embodiment, the angle conversion and transmission part 62 is formed to a specified length as described above, and is obliquely disposed with respect to the respective moving directions of the driving part 61 and the diaphragm 21.

As described above, the speaker device 1 includes the diaphragm 21; the frame 3 vibratably supporting the diaphragm 21 in the vibration direction; the magnetic circuit 5 disposed in the frame 3; and the driving member 26 for driving the diaphragm 21. The driving member 26 includes the voice coil 611 movably disposed in the magnetic gap 5 of the magnetic circuit; the driving part 61 formed movably in a direction different from the vibration direction of the diaphragm 21; and the angle conversion and transmission part 62, one end of which is foldably joined to the driving part 61 and the other end of which is bendably joined to the diaphragm 21. The angle conversion and transmission part 62 has rigidity and is obliquely disposed with respect to each of the vibration direction of the diaphragm 21 and the moving direction of the driving part.

That is, since the speaker device 1 includes the driving part 61 disposed movably in a direction different from the vibrating direction of the diaphragm 21, preferably in a direction perpendicular to the vibrating direction of the diaphragm 21; and the angle conversion and transmission part 62 obliquely disposed with respect to each of the vibrating direction of the diaphragm 21 and the moving direction of the driving part 61, the dimension (total height of a speaker) in the sound emission direction is smaller than typical speakers. This means that it is possible to provide a flat speaker.

Also, compared with a speaker device adapted to transmit a driving force by utilizing the flexibility of a flexible member when transmitting a driving force from a voice coil to a diaphragm, in the speaker device of the present invention, a driving force is transmitted from the driving part to the diaphragm by the rigid angle convert and transmit member, and therefore a decrease in response due to distortion of a flexible member is almost little, for example, and it is possible to vibrate the diaphragm with relatively high sensitivity. Further, since the flexible member hardly resonates (especially at low frequencies), it is possible to transmit a driving force of the driving part to the diaphragm efficiently.

Also, compared with a typical electrostatic speaker device, the speaker of the present invention converts the angle of a driving force developed in the voice coil of the driving part and transmits it to the diaphragm via the angle conversion and transmission part configured as described above, and therefore it is possible to emit relatively loud and high quality reproduced sound.

Further, since the speaker device 1 includes the driving part 61 in a shape of a flat plate and the angle conversion and transmission part 62 having configuration as described above, it is possible to make the speaker device 1 relatively flat. Also, since the voice coil 611 is in a shape of a thin flat plate and thus it is possible to make an area in the magnetic gap relatively large, a relatively strong driving force can be obtained when the speaker is driven.

Second Embodiment

Figure 7:
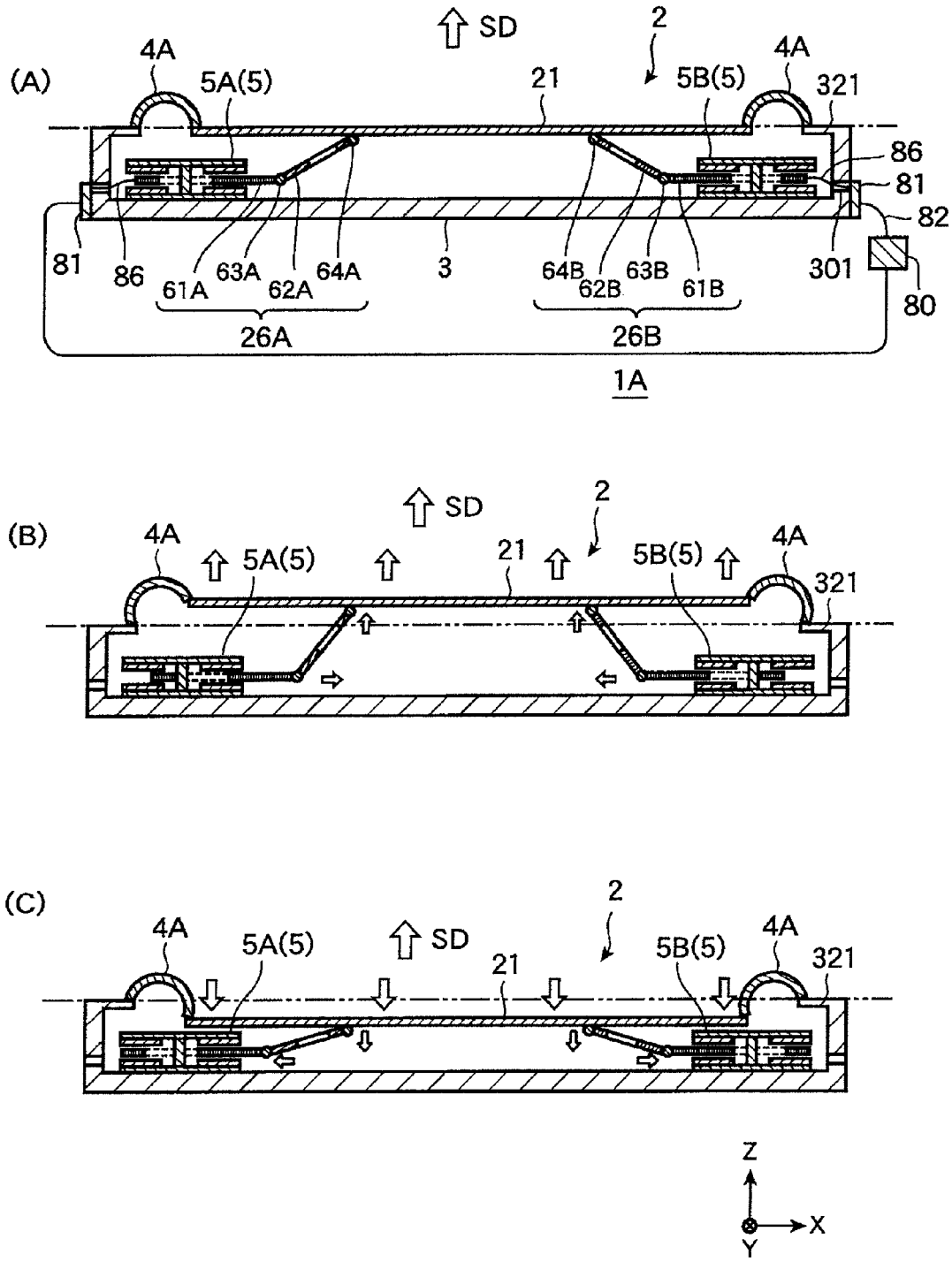
FIGS. 7A to 7C are diagrams illustrating a speaker device 1A according to a second embodiment of the present invention. Specifically.

FIGS. 7A to 7C illustrate the speaker device 1A according to a second embodiment of the present invention. Specifically, FIG. 7A is a cross-sectional view of the speaker device 1A when the diaphragm is not displaced with respect to a reference position. FIG. 7B is a cross-sectional view of the speaker device 1A when the diaphragm is displaced to the sound emission side with respect to the reference position. FIG. 7C is a cross-sectional view of the speaker device 1A when the diaphragm is displaced to the side opposite of the sound emission side. The same configurations in the first embodiment are not described here.

The speaker device 1A of this embodiment includes plural magnetic circuits and driving members, specifically two magnetic circuits 5A and 5B and two driving members 26A and 26B. The driving member 26A includes a driving part 61A in which a voice coil is formed, an angle conversion and transmission part 62A, a folding part 63A, a folding part 64A, whereas the driving member 26B includes a driving part 61*b* in which a voice coil is formed, an angle conversion and transmission part 62B, a folding part 63B, and a folding part 64B.

The two magnetic circuits 5A and 5B are configured such that the driving parts 61A and 61B move in the X-axis direction and the driving directions of the driving parts 61A and 61B are opposite to each other. The upper ends of the angle conversion and transmission parts 62A and 62B foldably support the diaphragm 21 at a specified distance from the center (barycentric position) of the diaphragm.

An edge 4A of this embodiment is convex towards the sound emission direction.

In the speaker device 1A of the above configuration, for example, when the same audio signal is input from the audio processing device 80 to the voice coils of the driving parts 61A and 61B via terminals 81 on each side respectively, Lorentz forces (driving forces) are developed in an opposite direction to each other along the X direction, as shown in FIGS. 7A to 7C. The driving parts 61A and 61B vibrate in an opposite direction to each other along the X-axis direction. Then, the driving force is transmitted to the diaphragm 21 via the angle conversion and transmission parts 62A and 62B to vibrate the diaphragm 21 in the Z direction.

Now, the operation of the speaker device 1A is described with reference to FIGS. 7A to 7C.

In the speaker device 1A, when the same audio signal is input to the voice coils of the driving parts 61A and 61B via the terminals 81 on each side respectively, Lorentz forces (driving force) are developed in an opposite direction to each other along the X-axis direction, as shown in FIGS. 7A to 7C. The driving parts 61A and 61B vibrate in an opposite direction to each other along the X-axis direction. Then, the driving force is transmitted to the diaphragm 21 via the angle conversion and transmission parts 62A and 62B to vibrate the diaphragm 21 in the Z-axis direction. At this time, since the driving parts 61A and 61B vibrate in an opposite direction to each other along the X-axis direction, it is possible to cancel unnecessary vibrations. That is, compared with the first embodiment, the speaker device 1A of this embodiment allows emission of relatively high quality sound waves.

Further, in the speaker device 1A of the above configuration, since the angle conversion and transmission parts 62A and 62B are foldably joined to the diaphragm 21 away from each other at a specified distance to transmit driving forces to the diaphragm 21, it is possible to suppress the occurrence of a local deflection of the diaphragm 21. In the speaker device 1A of this configuration, it is also possible to vibrate the entire diaphragm 21 substantially in-phase.

Third Embodiment

Figure 8:
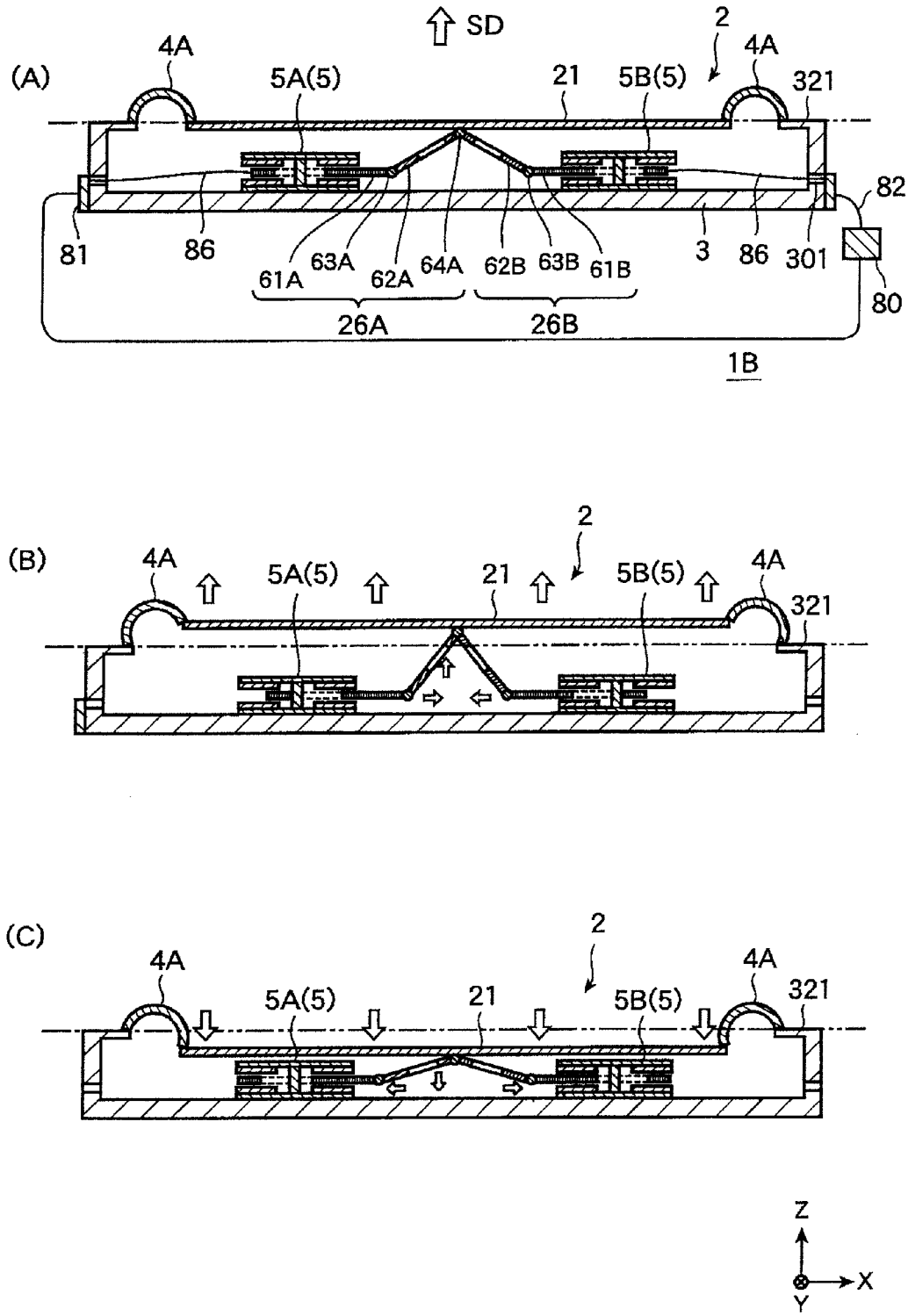
FIGS. 8A to 8C are diagrams illustrating the speaker device 1B according to a third embodiment of the present invention. Specifically.

FIGS. 8A to 8C are diagrams illustrating a speaker device 1B according to a third embodiment of the present invention. Specifically, FIG. 8A is a cross-sectional view of the speaker device 1B when a diaphragm is not displaced with respect to a reference position. FIG. 8B is a cross-sectional view of the speaker device 1B when the diaphragm is displaced to the sound emission side with respect to the reference position. FIG. 8C is a cross-sectional view of the speaker device 1B when the diaphragm is displaced on the side opposite of the sound emission side with respect to the reference position. The same configurations in the first and second embodiments are not described here.

As shown in FIGS. 8A to 8C, in the speaker device 1B of this embodiment, the angle conversion and transmission parts 62A and 62B are foldably joined to the central portion (barycentric position) of the diaphragm 21. Also, compared with the second embodiment, the magnetic circuits 5A and 5B are arranged such that the distance between them is shorter. Further, the angle conversion and transmission parts 62A and 62B are arranged such that the distance between them is also shorter compared with the second embodiment. Preferably, the diaphragm 21 has relatively high rigidity.

In the speaker device 1B of the above configuration, it is possible to suppress the occurrence of a local deflection of the diaphragm 21 and also to reduce the dimension in the X-axis direction as compared with the second embodiment. This means that it is possible to provide a flat and compact speaker device.

Fourth Embodiment

Figure 9:
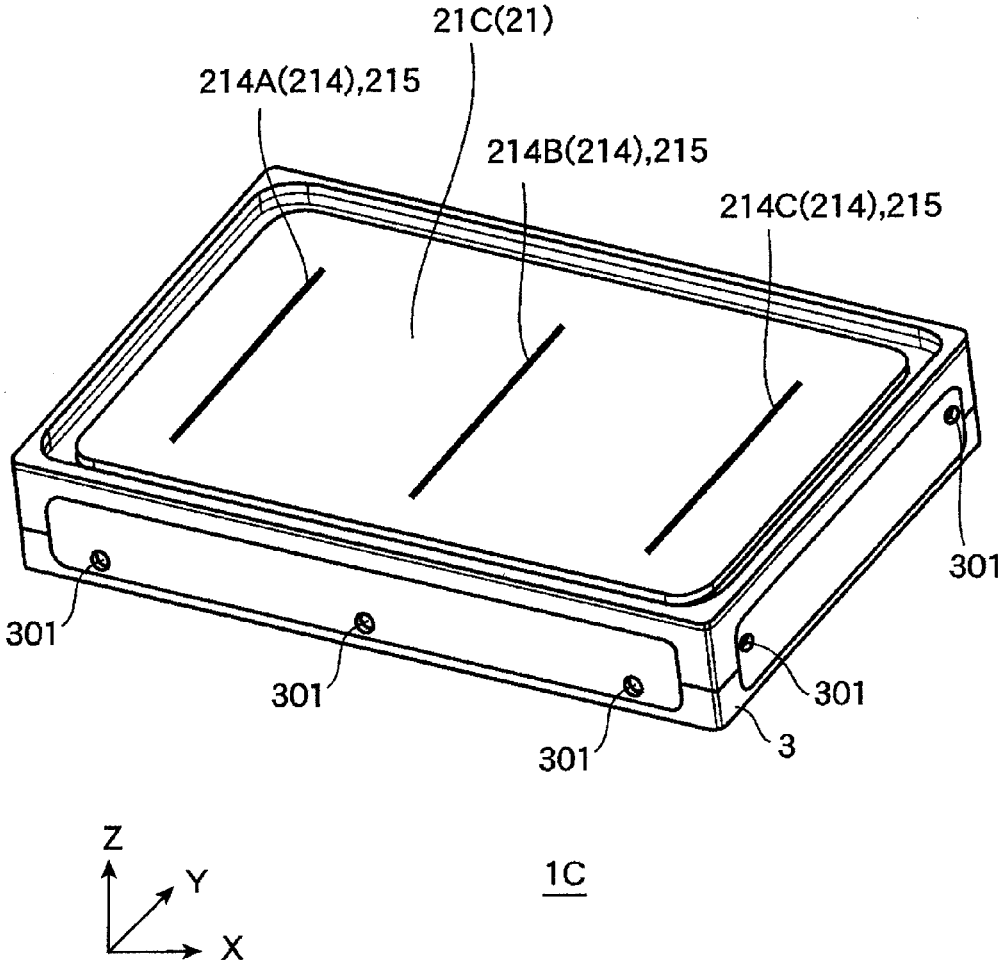
FIG. 9 is a perspective view of a speaker 1C according to a fourth embodiment of the present invention.
Figure 10:
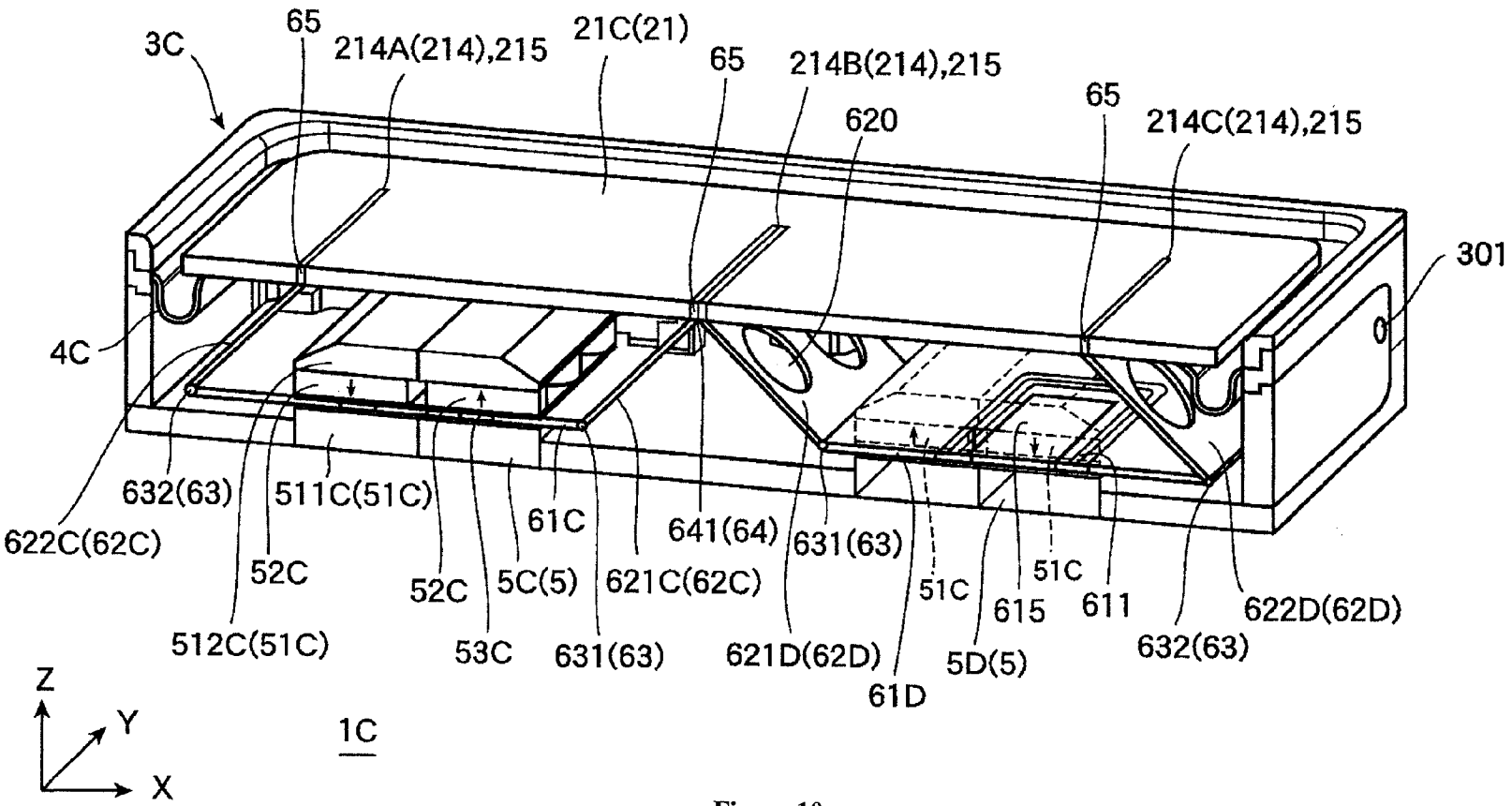
FIG. 10 is a cross-sectional perspective view of the speaker device 1C shown in FIG. 9.
Figure 11:
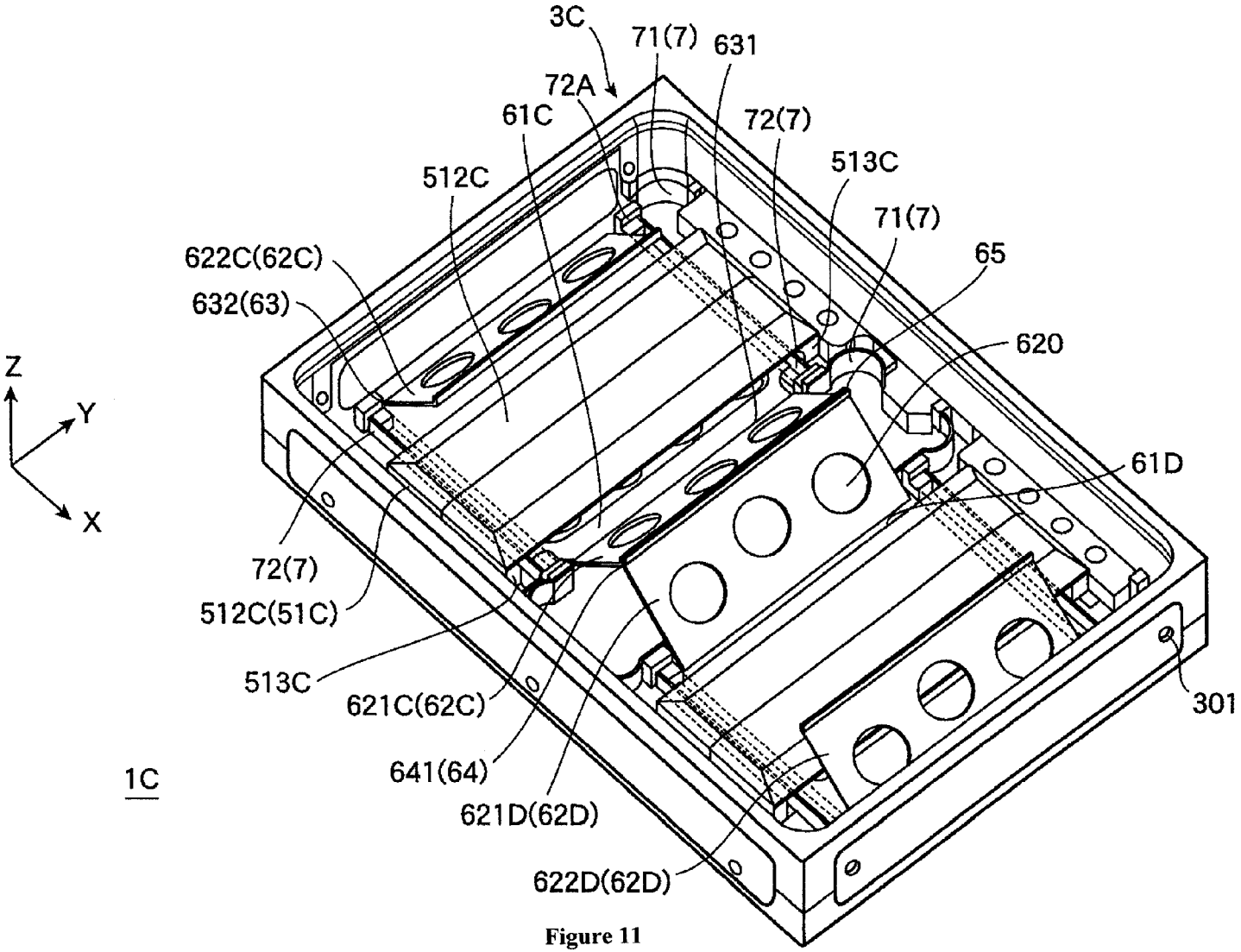
FIG. 11 is a perspective view of a substantial part of the speaker device 1C shown in FIG. 9.
Figure 12:
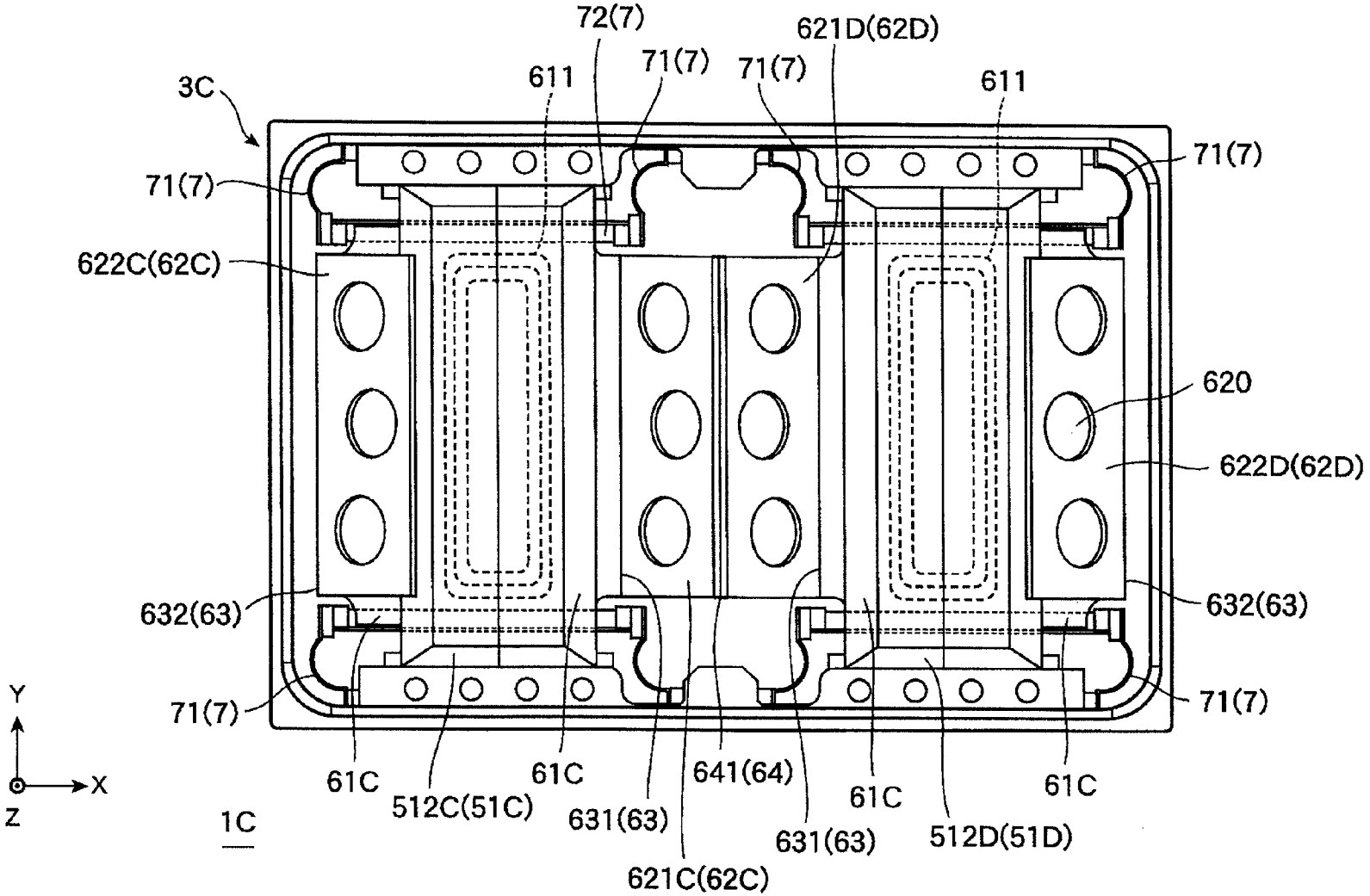
FIG. 12 is a top view of a substantial part of the speaker device 1C shown in FIG. 9.

FIG. 9 is a perspective view of a speaker device 1C according to a fourth embodiment of the present invention. FIG. 10 is a cross-sectional perspective view of the speaker device 1C shown in FIG. 9. FIG. 11 is a top view of a substantial part of the speaker device 1C shown in FIG. 9. FIG. 12 is a top view of a substantial part of the speaker device 1C shown in FIG. 9. The same configurations in the first to third embodiments are not described here. In FIG. 10, part of the right side, as seen from the reader, of the magnetic circuit 5D is not shown.

The speaker device 1C of this embodiment includes a diaphragm 21C (21), a frame 3C, an edge (support member) 4C, magnetic circuits 5C and 5D, driving parts 61C and 61D (61), angle conversion and transmission parts 62C and 62D, and dampers (restraint parts) 7, as shown in FIGS. 9 to 12.

To the ends of the driving part 61C, angle conversion and transmission parts 621C and 622C are joined via folding parts 631 and 632 (63) respectively, and the driving part has the angle conversion and transmission parts 621D and 622D formed on the respective ends in the driving direction via folding parts 631 and 632 (63).

Also, the angle conversion and transmission parts 621C and 621D are foldably joined to the center (barycentric position) of the diaphragm 21 via the folding part 641 (64). Further, the angle convert parts 622C and 622D are foldable joined to the diaphragm 21 at a point off the center (barycentric position) in the outer periphery side, via the folding part.

Also, each of the angle conversion parts 621C, 622C, 621D, and 622D of this embodiment has a folded end part 65 formed in the vicinity of each end part thereof, and the folded end part 65 fits into a groove 214 (214A to 214C) formed in the diaphragm 21C.

Further, the folded end part 65 is fixed in a state where it protrudes from a surface of the diaphragm 21, for example. Since a protruded part 215 is formed in this diaphragm 21 and thus is relatively strong, it is possible to suppress the occurrence of a deflection or the like of the diaphragm and vibrate the entire diaphragm 21C substantially in-phase.

Also, the angle conversion and transmission parts 621C and 622C are substantially the same in length and obliquely disposed at substantially the same angle with respect to the diaphragm 21C and the driving part 61C in parallel with each other. Similarly, the angle conversion and transmission parts 621D and 622D are substantially the same in length and obliquely disposed at substantially the same angle with respect to the diaphragm 21C and the driving part 61D in parallel with each other.

Further, the magnetic circuit 5C is provided between the angle conversion and transmission parts 621C and 622C, and the magnetic circuit 5D is disposed between the angle conversion and transmission parts 621D and 622D.

In the speaker device 1C of the above configuration, since an angle conversion and transmission part is provided at each end in the moving direction of a driving part, the magnetic circuit 5C and 5D are provided between the angle conversion and transmission parts, and the diaphragm 21C is supported by a plurality of angle conversion and transmission parts disposed at both ends of the driving parts, it is possible to vibrate the diaphragm 21C substantially in-phase and cancel vibrations generated in each driving part. It is also possible to reduce the X direction dimension of the speaker device 1C.

Also, the magnetic circuits 5C and 5D of this embodiment each include a yoke 51C, a magnet 52C, and a plate 53C. The magnet 52C may be of, for example, a plurality of tubular magnets or semi-tubular magnets. The plate 53 is provided at the bottom of the magnet 52C, and magnetic flux is uniformly distributed in the magnetic gap.

The yoke 51C includes, for example, a flat plate 511C, a flat plate 512C disposed on the flat plate 511C at specified intervals, and a support 513C disposed at both ends in the Y direction of the flat plate 511C and extending in the Z direction.

The restraint part 7C (7) of this embodiment includes a damper 71 and a support 72 supporting the driving part. The support 72 is, for example, an L-shaped member formed in a longitudinal direction along both ends of the driving part, and supports each driving part. The end part 72A of the support 72 is vibratably supported by the frame via the damper 71. That is, each driving part is formed movably only in the X direction by the restraint part 7C. Also, the damper 71 of this embodiment is formed in a damper shape, substantially symmetrically with respect to an axis parallel to the Y-axis that runs in the middle of the two angle conversion and transmission parts. Specifically, the damper 71 is convex from this axis to a direction away from it.

As described above, the speaker device 1C of this embodiment has an angle conversion and transmission part at each end of each driving part in the moving direction. Also, the two angle conversion and transmission parts provided in the driving part are foldably joined to the diaphragm at the same angle so as to be substantially parallel to each other, and the magnetic circuit is disposed between the two angle conversion and transmission parts.

Accordingly, in the speaker device 1C, since the diaphragm 21 is supported by the plurality of angle conversion and transmission parts disposed at both ends of the driving part, it is possible to drive the entire diaphragm 21C substantially in-phase and cancel the vibrations generated in each driving part. It is also possible to transmit a relatively strong driving force to the diaphragm 21C efficiently. It is further possible to make the speaker device 1C relatively compact.

Also, since the damper 71 and the support 72 are provided as the restraint part 7, it is possible to ensure the movement of each driving part in the X-axis direction only.

Modifications

Figure 13:
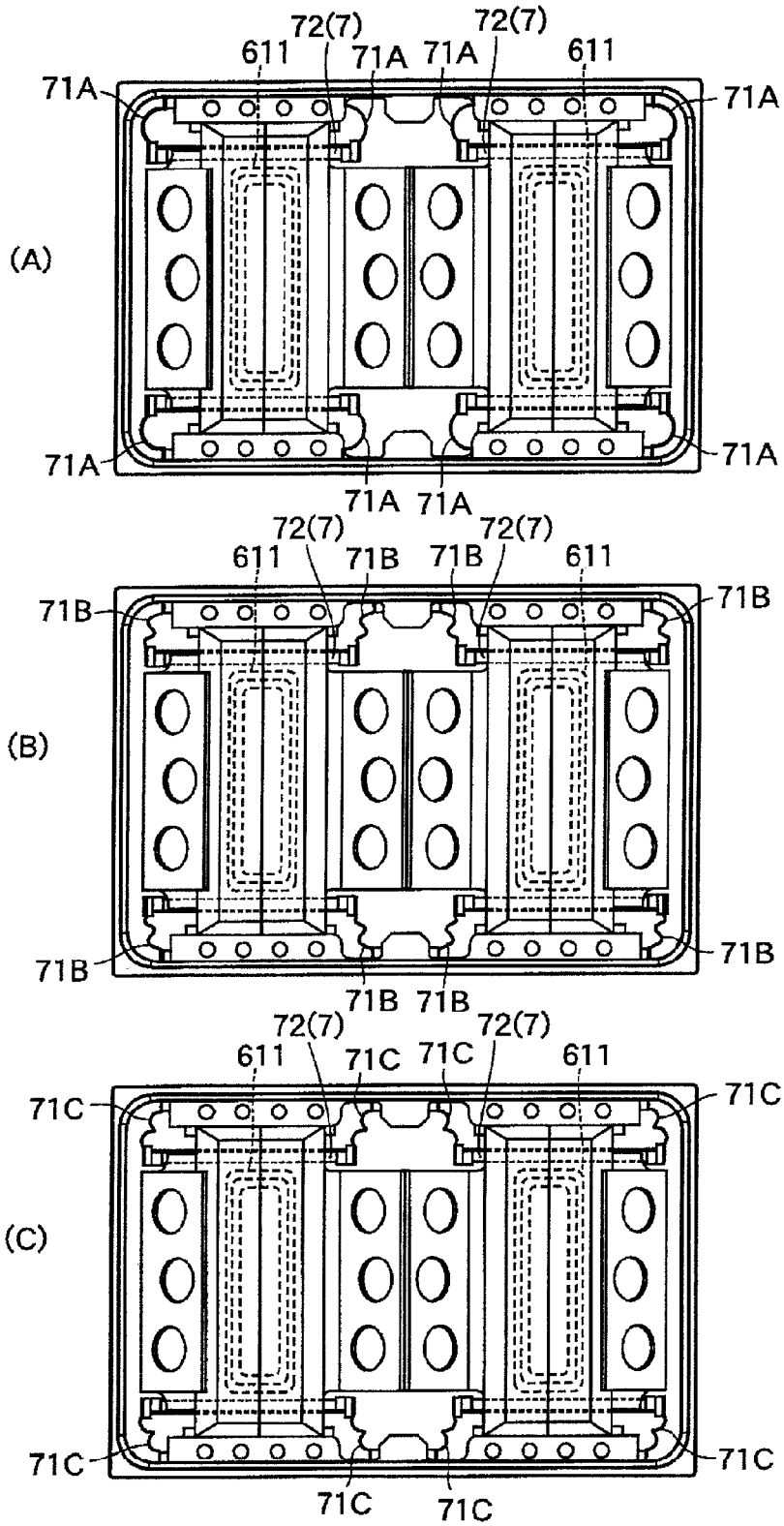
FIG. 13A is a top view illustrating a speaker device according to a first modification.
FIG. 13B is a top view illustrating a speaker device according to a second modification.
FIG. 13C is a top view illustrating a speaker device according to a third modification.

FIG. 13A illustrates a speaker device of a first modification. FIG. 13B illustrates a speaker device of a second modification. FIG. 13C illustrates a speaker device of a third modification.

The restraint part 7 is not limited to the embodiment described above and, as shown in FIG. 13A for example, each of the plurality of dampers 71A may be formed into similar shapes to each other, and also may be arranged substantially symmetrically with respect to an axis that runs in the middle of the two magnetic circuits and is parallel to the Y-axis direction.

Also, as shown in FIG. 13B, each of the plurality of dampers 71B may be corrugated and may be arranged substantially symmetrically with respect to an axis that runs in the middle of the two magnetic circuits and is parallel to the Y-axis direction.

Further, as shown in FIG. 13C, each of the plurality of dampers 71C may have a cross-section like combined arcs and may be arranged substantially symmetrically with respect to an axis that runs in the middle of the two magnetic circuits and is parallel to the Y-axis direction.

Also, the damper may have other shapes than described above and may be arranged differently.

Other Embodiments

Figure 14:
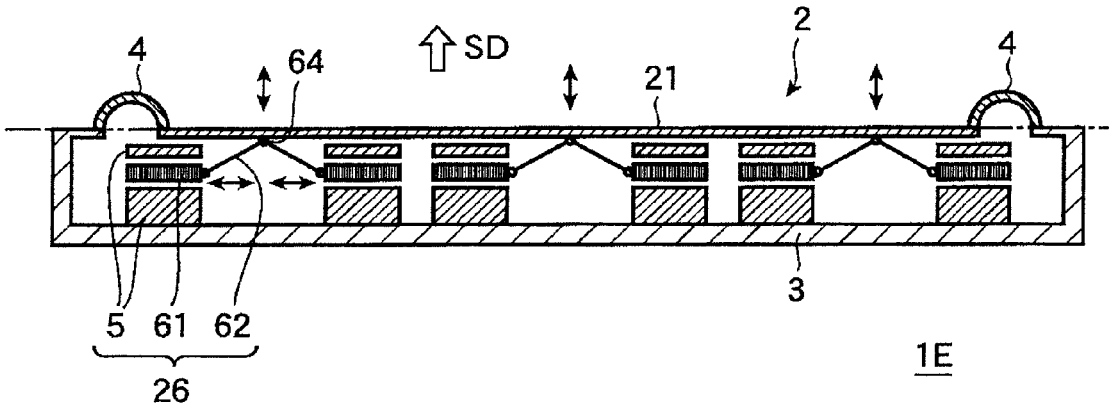
FIG. 14 is a cross-sectional view of a speaker device 1E according to another embodiment of the present invention.

FIG. 14 is a cross-sectional view of the speaker device of another embodiment.

The speaker device of the present invention is not limited to the embodiments described above.

For example, as shown in FIG. 14, the speaker device 1E may have more than one pair of magnetic circuit and driving member as described in the third embodiment. In the speaker device 1E of this configuration, the thickness of the speaker is uniform and it is possible to attain a relatively strong driving force. Also, by supporting a diaphragm 21C by a plurality of angle conversion and transmission parts provided at both ends of a driving part, it is possible to drive the entire diaphragm 21C substantially in-phase and to cancel vibrations generated in each driving part.

Figure 15:
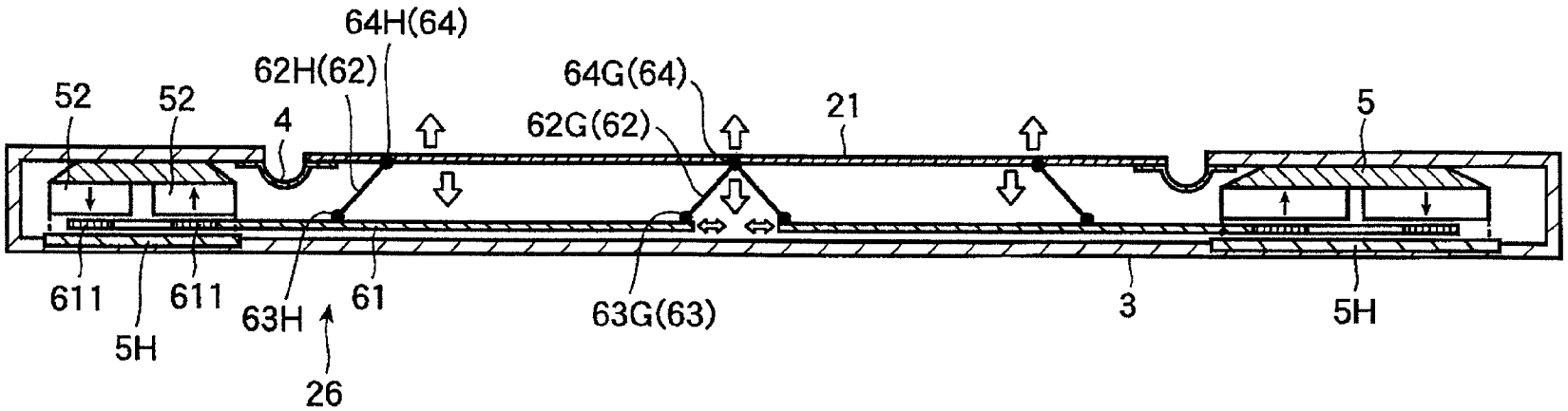
FIG. 15 is a cross-sectional view illustrating a modification of the speaker device according to the second embodiment of the present invention.

FIG. 15 is a cross-sectional view of a speaker device 1H according to another embodiment of the present invention.

A magnetic circuit may be provided in the vicinity of the periphery of a vibrating body (a diaphragm and a driving member). Since the magnetic circuit is disposed in the vicinity of the outer periphery, it is possible to make the speaker flat.

Also, as shown in FIG. 15, in the speaker device 1H of the present invention, the magnetic circuit 5H is provided in the vicinity of the outer periphery of the vibrating body (a diaphragm and a driving part).

In the speaker device 1H of the above configuration, by disposing the magnetic circuit 5H in the vicinity of the outer periphery of the vibrating body, it is possible to make the total height of the speaker device smaller than conventional speaker devices. Though not shown, it is also possible to use a magnetic circuit to be employed for conventional speaker devices by laying down the magnetic circuit with respect to the vibration direction of the diaphragm.

Figure 16:
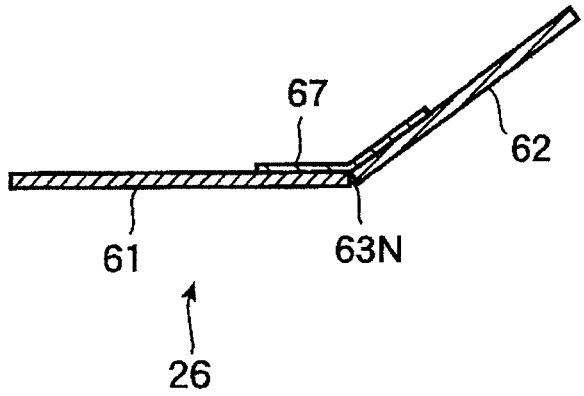
FIG. 16 illustrates a first modification of a folding part of a speaker device of the present invention.
Figure 16:
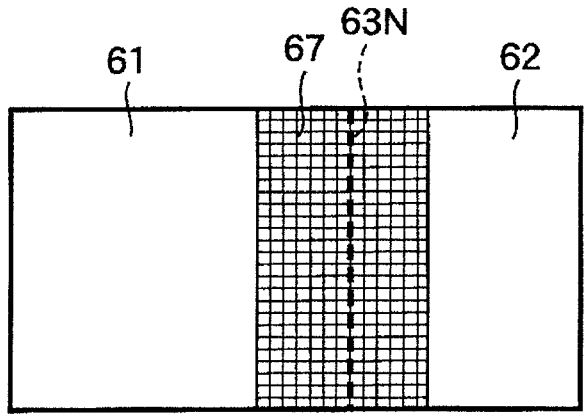
Figure 17:
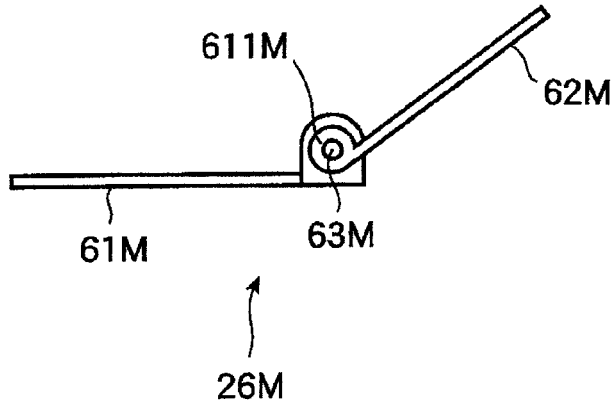
FIG. 17 illustrates a second modification of a folding part of a speaker device of the present invention.
Figure 17:
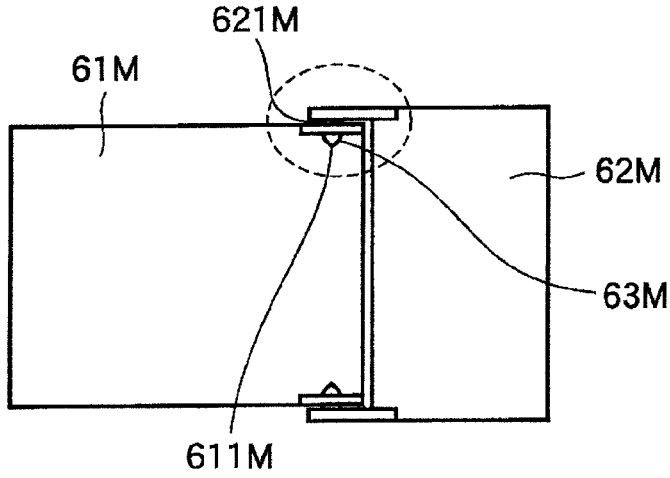
Figure 17:
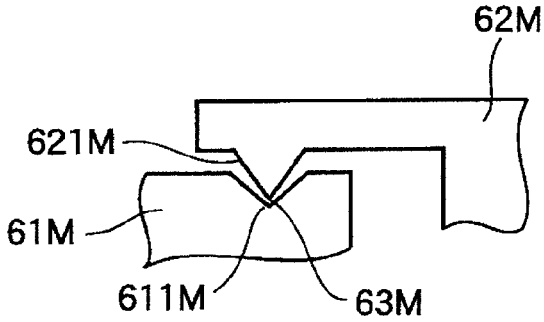

FIGS. 16 and 17 illustrate modifications of a folding part 63 joining an angle conversion and transmission part 62 and a driving part 61.

As shown in FIG. 16, the folding part 63N may be formed of a flexible member and join angle-variably the angle conversion and transmission part 62 and the driving part 61. Specifically, as shown in FIG. 16, the folding part 63N is made of an unwoven fabric 67 composed of, for example, polymeric fiber such as a polyaramid fiber, a resin such as a phenolic resin series, and the like, and foldably joins the angle conversion and transmission part 62 and the driving part 61.

The folding part 63N may be formed as bendable part made of, for example, a bendable resin film or the like other than an unwoven fabric, and the material of the folding part is not limited Further, as shown in FIG. 17, the folding part 63M may be hinged to angle-variably join the angle conversion and transmission part 62M and the driving part 61M. Specifically, as shown in FIG. 17, the angle conversion and transmission part 62M has projections formed at the end thereof; the driving part 61M has holes at the end thereof in which the projections can be fitted, so that the angle conversion and transmission part 62M and the driving part 61M can be foldably joined. Alternatively, it is possible to form projections in the driving part 61M and holes in the angle conversion and transmission part 62M to foldably join the angle conversion and transmission part.

Also, the folding part 61M made of the unwoven fabric above or the like may be used to join the diaphragm 21 and the angle conversion and transmission part 62M.

It is also possible to foldably join the angle conversion and transmission part 62M and the driving part 61M by forming projections in the angle conversion and transmission part and holes in the diaphragm 21, or to foldably join the angle conversion and transmission part 62M and the diaphragm 21 by forming projections in the diaphragm 21 and holes in the angle conversion and transmission part 62M.

Further, it is possible to angle-variably join the angle conversion and transmission part 62M and the diaphragm 21 by means of the bending part or a hinge made of the above mentioned flexible member.

As described above, the speaker device 1 includes the diaphragm 21; the frame 3 vibratably supports the diaphragm 21 in the vibration direction; the magnetic circuit 5 provided in the frame 3; and the driving member 26 for driving the diaphragm 21. The driving member 26 includes; the driving part 61 including the voice coil 611 disposed movably in the magnetic gap 59 of the magnetic circuit and which is formed movably in a direction different from the vibration direction of the diaphragm 21; and the angle conversion and transmission part 62, one end of which is angle-variably joined to the driving part 61 and the other end of which is angle-variably joined to the diaphragm 21. The angle conversion and transmission part 62 has rigidity and is obliquely disposed with respect to each of the vibration direction of the diaphragm 21 and the moving direction of the driving part.

In other words, since the speaker device 1 has the driving part 61 disposed movably in a direction different from the vibration direction of the diaphragm 21, preferably in a direction perpendicular to the vibration direction of the diaphragm 21, and the angle conversion and transmission part 62 obliquely disposed with respect to each of the vibration direction of the diaphragm 21 and the moving direction of the driving part 61, the dimension in the sound emission direction is smaller than typical speaker devices. This means that it is possible to provide a flat speaker device.

The present invention is not limited to the embodiments described above. For example, the angle conversion and transmission part may be bendably joined directly to the voice coil.

Also, the diaphragm, the driving part with a coil, and the angle conversion and transmission part may be integrally formed.

Further, although the speaker device according to the above mentioned embodiments includes the magnetic circuit and the movable voice coil in order to drive the driving member 26, the present invention is not limited to those embodiments. For example, a driving force generated by a piezoelectric device may be transmitted to the diaphragm.

Further, it is possible to angle-variably join an end of the angle conversion and transmission part and the driving part and to angle-variably join the other end thereof and the diaphragm, by making bendable the part joining the driving part and the angle conversion and transmission part and making foldable the part joining the diaphragm and the angle conversion and transmission part. It is also possible to make foldable the part joining the driving part and the angle conversion and transmission part, make bendable the part joining the diaphragm and the angle conversion and transmission part, or make bendable both the part joining the driving part and the angle conversion and transmission part and the part joining the diaphragm and the angle conversion and transmission part. Thus, the invention is not limited to any of these embodiments.

What is claimed is:

1. A speaker device comprising:

a diaphragm;

a frame supporting the diaphragm vibratably in a vibration direction of the diaphragm;

a magnetic circuit disposed in the frame; and a driving member adapted to drive the diaphragm, wherein the driving member comprises:

a driving part comprising a voice coil movably disposed in a magnetic gap of the magnetic circuit, wherein the driving part is formed movably in a direction different from the vibration direction of the diaphragm; and a rigid angle conversion and transmission part, wherein one end of the rigid angle conversion and transmission part is angle-variably joined to the driving part, wherein another end of the rigid angle conversion and transmission part is angle-variably joined to the diaphragm, and wherein the rigid angle conversion and transmission part is obliquely disposed with respect to each of the vibration direction of the diaphragm and the moving direction of the driving part.

2. The speaker device according to claim 1, wherein the one end of the rigid angle conversion and transmission part is bendably or foldably joined to the driving part, and wherein the other end is bendably or foldably joined to the diaphragm.

3. The speaker device according to claim 1, wherein the one end of the rigid angle conversion and transmission part vibrates in the moving direction of the driving part and the other end vibrates in the vibration direction of the diaphragm, and wherein the rigid angle conversion and transmission part converts the direction of a driving force in the moving direction of the voice coil to a direction along the direction of the diaphragm and transmits the driving force from the driving part to the diaphragm.

4. The speaker device according to claim 1, wherein the driving part is formed movably in a direction perpendicular to the vibration direction of the diaphragm.

5. The speaker device according to claim 1, further comprising:

at least one additional magnetic circuit; and at least one additional driving member.

6. The speaker device according to claim 5, wherein rigid angle conversion and transmission parts of the driving members are bendably or foldably joined to the diaphragm at a specified interval.

7. The speaker device according to claim 5, wherein rigid angle conversion and transmission parts of the driving members are bendably or foldably joined to the diaphragm such that ends of the rigid angle conversion and transmission parts joined to the driving parts are in contact with each other.

8. The speaker device according to claim 5, wherein driving parts of the driving members are configured to vibrate in an opposite direction to each other.

9. The speaker device according to claim 1, wherein the magnetic circuit is disposed in the vicinity of a periphery of a vibrating body including the diaphragm and the driving member.

10. The speaker device according to claim 1, wherein the rigid angle conversion and transmission part is formed into a shape of a flat plate.

11. The speaker device according to claim 1, wherein the driving part is formed into a shape of a flat plate.

12. The speaker device according to claim 1, wherein the driving part has the voice coil disposed in a magnetic gap of the magnetic circuit and includes an insulating member extending from the voice coil to outside of the magnetic gap in the moving direction, and wherein the rigid angle conversion and transmission part is joined to an end in the moving direction of the insulating member via a folding part or a bending part.

13. The speaker device according to claim 1, wherein the driving part has an opening.

14. The speaker device according to claim 1, wherein the diaphragm is vibratably supported in the vibration direction by the frame via an edge.

15. The speaker device according to claim 1, further comprising a restraint part that supports the driving part movably in the moving direction and suppresses a movement in other direction.

16. The speaker device according to claim 1, wherein a vent hole is formed in the frame.

17. The speaker device according to claim 1, wherein the diaphragm is formed into a shape of a flat plate.

18. The speaker device according to claim 1, wherein a projection is formed in the diaphragm.

19. The speaker device according to claim 1, wherein the rigid angle conversion and transmission part and the driving part, or the rigid angle conversion and transmission part and the diaphragm, are joined via a folding part or a bending part.

20. An appliance comprising the speaker claimed in claim 1.

21. A vehicle comprising the speaker claimed in claim 1.

* * * * *